US010688783B2

(12) United States Patent
Machida et al.

(10) Patent No.: US 10,688,783 B2
(45) Date of Patent: Jun. 23, 2020

(54) DISCHARGING APPARATUS

(71) Applicant: AISIN SEIKI KABUSHIKI KAISHA, Kariya-shi (JP)

(72) Inventors: Takashi Machida, Kariya (JP); Tsuyoshi Yamamoto, Nagoya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 0 days.

(21) Appl. No.: 16/104,203

(22) Filed: Aug. 17, 2018

(65) Prior Publication Data

US 2019/0084300 A1 Mar. 21, 2019

(30) Foreign Application Priority Data

Sep. 19, 2017 (JP) ..... 2017-179039

(51) Int. Cl.

| | |
|---|---|
| ***B41J 2/175*** | (2006.01) |
| ***B41J 2/045*** | (2006.01) |
| ***B41J 2/04*** | (2006.01) |
| ***B41J 2/195*** | (2006.01) |
| ***B41J 2/125*** | (2006.01) |
| ***B41J 29/38*** | (2006.01) |
| ***B41J 2/165*** | (2006.01) |

(52) U.S. Cl.

CPC ..... *B41J 2/04573* (2013.01); *B41J 2/04* (2013.01); *B41J 2/04586* (2013.01); *B41J 2/125* (2013.01); *B41J 2/16517* (2013.01); *B41J 2/175* (2013.01); *B41J 2/195* (2013.01); *B41J 29/38* (2013.01)

(58) Field of Classification Search

CPC . B41J 2/04573; B41J 2/04; B41J 2/175; B41J 2/195; B41J 2/125; B41J 29/38; B41J 2/04586; B41J 2/16517

See application file for complete search history.

(56) References Cited

U.S. PATENT DOCUMENTS

2010/0053242 A1* 3/2010 Iwase ..... B41J 2/175 347/9
2015/0290943 A1* 10/2015 Gomi ..... B41J 2/175 347/85

FOREIGN PATENT DOCUMENTS

| | | |
|---|---|---|
| JP | 2-56271 | 2/1990 |
| JP | 2001-276716 | 10/2001 |
| JP | 2017-23956 | 2/2017 |

* cited by examiner

*Primary Examiner* — Yaovi M Ameh
(74) *Attorney, Agent, or Firm* — Oblon, McClelland, Maier & Neustadt, L.L.P.

(57) ABSTRACT

A discharging apparatus includes: a discharging unit that includes a liquid chamber which stores a liquid intermittently supplied from a liquid supply source and a nozzle which discharges the liquid stored in the liquid chamber; a pressure detection unit that detects a pressure of the liquid supplied to the liquid chamber; and a control unit that controls the discharging unit based on a detection result from the pressure detection unit, in which the control unit limits liquid discharging by the discharging unit in a case where the pressure of the liquid supplied to the liquid chamber does not fall within an allowable pressure range.

15 Claims, 9 Drawing Sheets

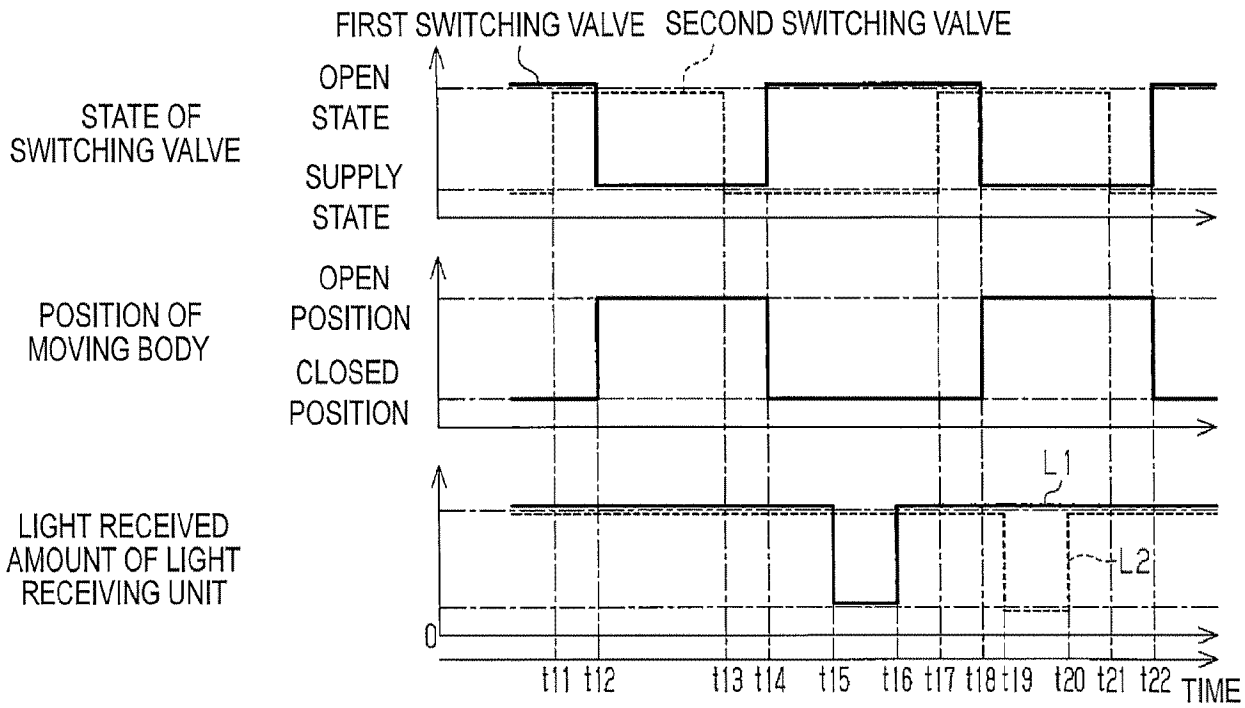
FIG.8A
FIG.8B
FIG.8C
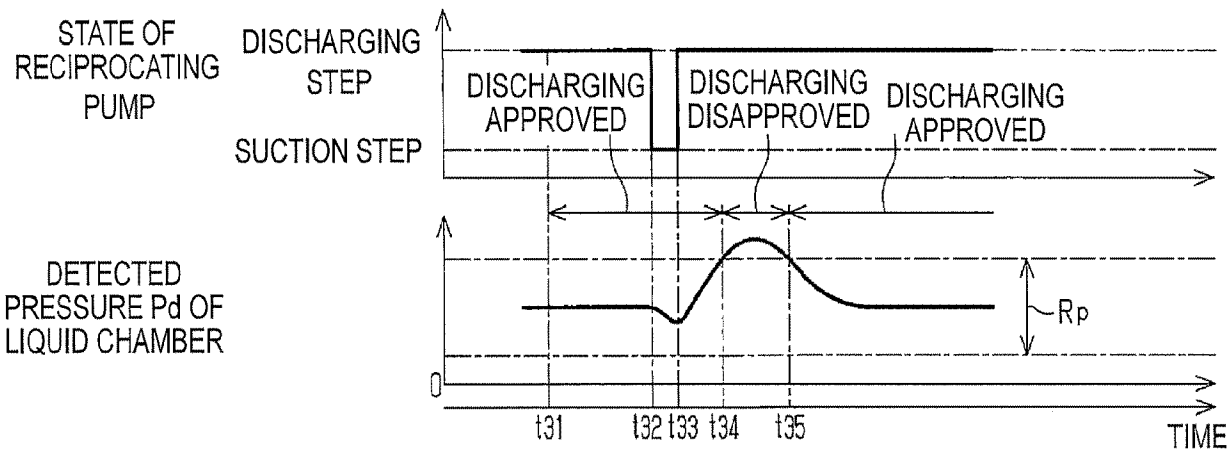
FIG.9A
FIG.9B

DISCHARGING APPARATUS

CROSS REFERENCE TO RELATED APPLICATIONS

This application is based on and claims priority under 35 U.S.C. § 119 to Japanese Patent Application 2017-179039, filed on Sep. 19, 2017, the entire contents of which are incorporated herein by reference.

TECHNICAL FIELD

This disclosure relates to a discharging apparatus that discharges a liquid.

BACKGROUND DISCUSSION

A painting device including a main tank that accommodates paint, a paint gun that discharges the paint, first circulation piping that connects main tank and the paint gun together such that the paint circulates between the main tank and the paint gun, and a pump that circulates the paint in the first circulation piping is disclosed as an example of a discharging apparatus in JP 2001-276716A (Reference 1). The painting device further includes an accumulator that smooths out the pressure of the paint, which pulsates due to the driving of the pump, in the first circulation piping and a regulator that regulates the pressure of the paint in the first circulation piping. In this manner, the painting device prevents a change in the pressure of the paint in the first circulation piping, and makes the amount of the paint applied to a target by the paint gun even.

However, in some cases, the accumulator and the regulator of such a painting device cannot completely prevent pressure fluctuations of the paint in the first circulation piping accompanying the driving of the pump. In this case, there is a possibility that the amount of the paint applied to the target by the paint gun becomes unstable. Thus, a need exists for a discharging apparatus which is not susceptible to the drawback mentioned above.

SUMMARY

A discharging apparatus according to an aspect of this disclosure includes a discharging unit that includes a liquid chamber which stores a liquid intermittently supplied from a liquid supply source and a nozzle which discharges the liquid stored in the liquid chamber, a pressure detection unit that detects a pressure of the liquid supplied to the liquid chamber, and a control unit that controls the discharging unit based on a detection result from the pressure detection unit. The control unit limits liquid discharging by the discharging unit in a case where the pressure of the liquid supplied to the liquid chamber does not fall within an allowable pressure range.

BRIEF DESCRIPTION OF THE DRAWINGS

The foregoing and additional features and characteristics of this disclosure will become more apparent from the following detailed description considered with the reference to the accompanying drawings, wherein:

FIGS. 8A to 8C are timing charts showing a state change when the discharging unit discharges the liquid;

FIGS. 9A and 9B are timing charts showing a state change when a supplying unit supplies the liquid to the discharging unit;

DETAILED DESCRIPTION

Hereinafter, embodiments of a discharging apparatus that discharges a liquid toward a work will be described with reference to the drawings. The discharging apparatus of the embodiment is a lubricant discharging apparatus that discharges a lubricant, such as grease, toward a sliding portion of the work. The sliding portion of the work is, for example, a portion that meshes with a gear, which is a configuring member of the work, or a portion where a bearing and a shaft, which are configuring members of the work, come into contact with each other.

Figure 1:
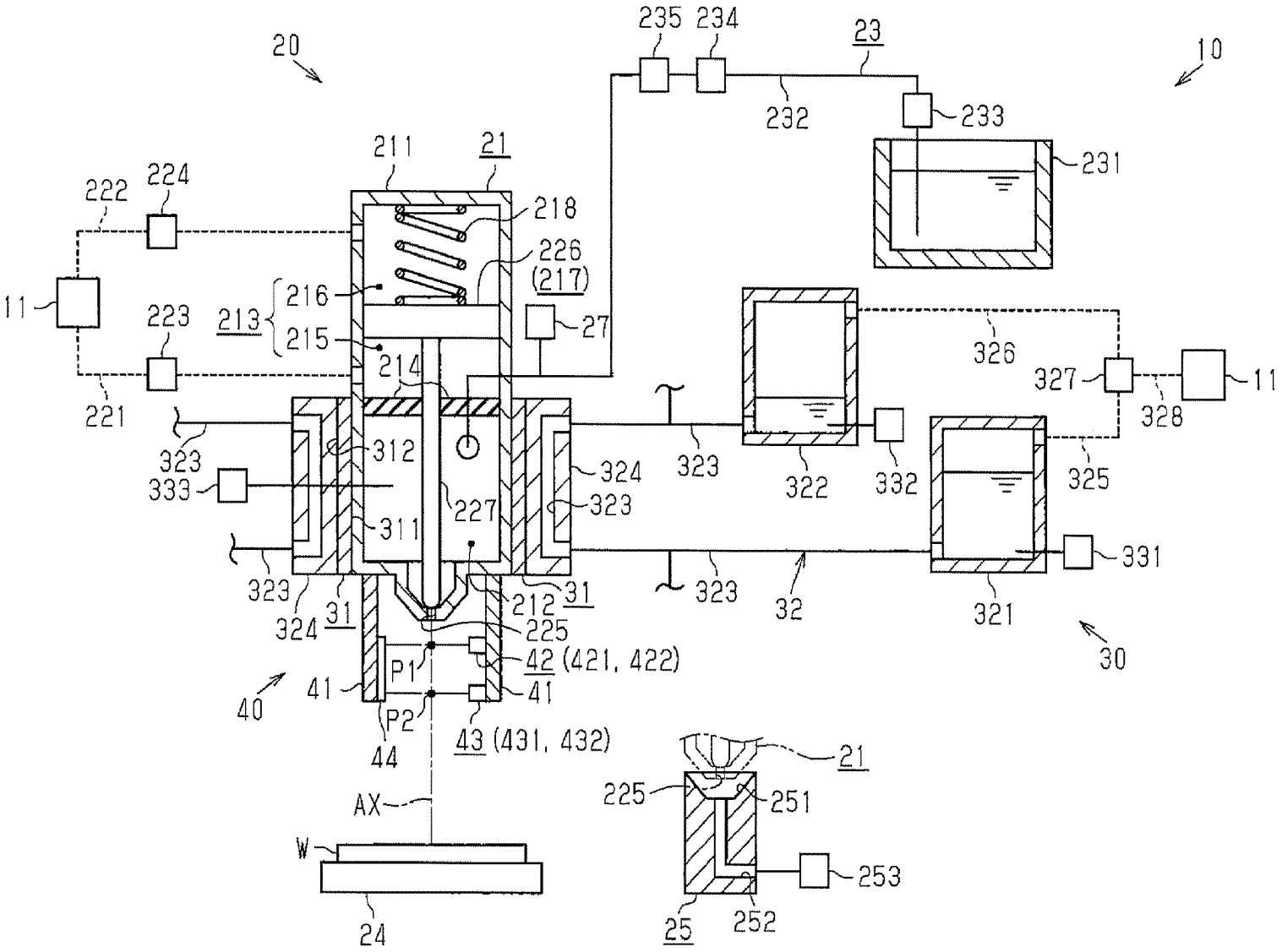
FIG. 1 is a schematic view illustrating a schematic configuration of a liquid discharging apparatus according to an embodiment.

As illustrated in FIG. 1, a discharging apparatus 10 includes a discharging device 20 that discharges a liquid toward a work W, a temperature regulating device 30 that regulates the temperature of the liquid discharged from the discharging device 20, and an inspection device 40 that checks a liquid discharging state of the discharging device 20.

Figure 2:
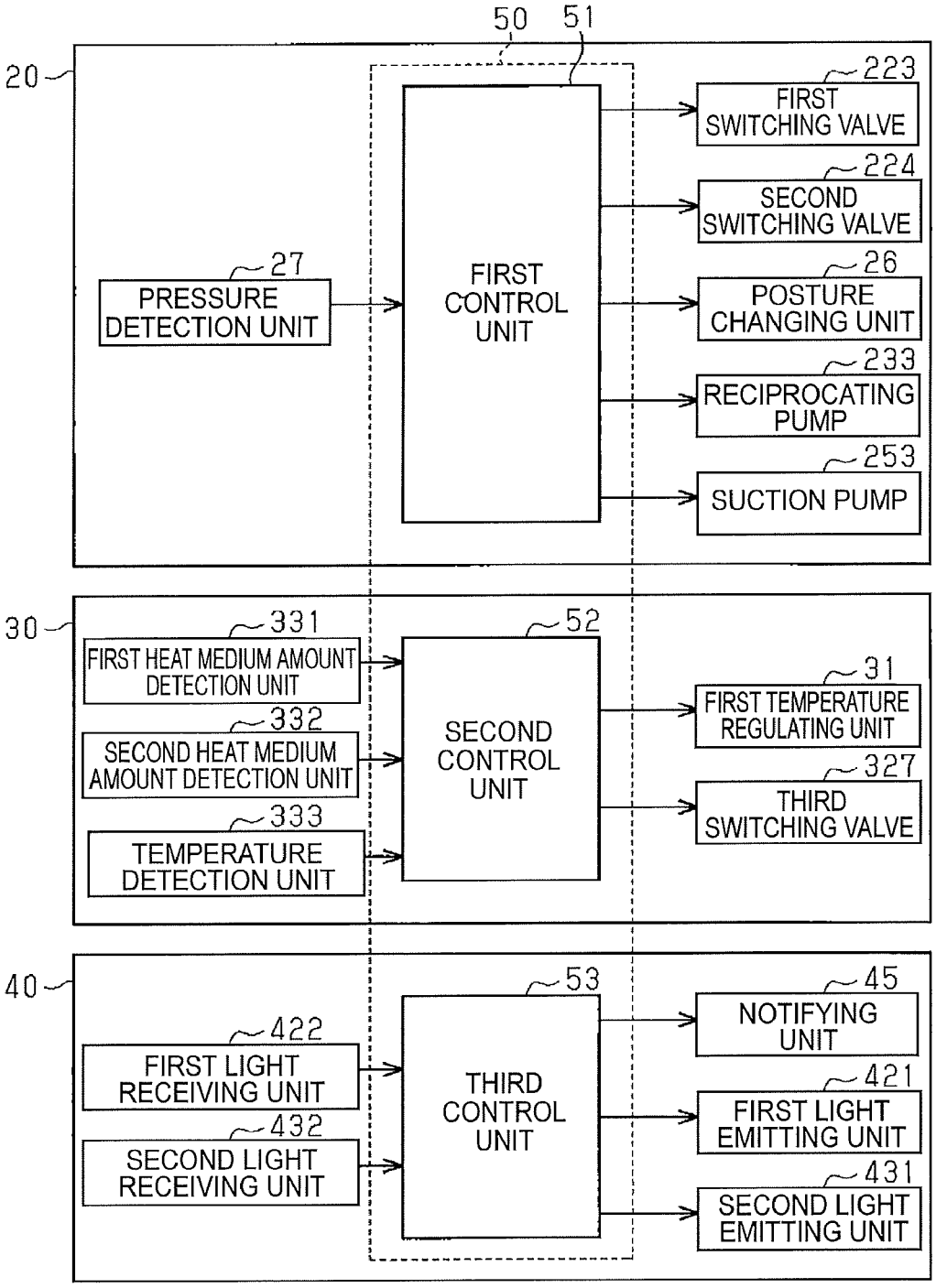
FIG. 2 is a block diagram showing an electrical configuration of the liquid discharging apparatus.

As illustrated in FIG. 1, the discharging device 20 includes a discharging unit 21 that discharges a liquid, a supplying unit 23 that supplies the liquid to the discharging unit 21, a supporting unit 24 that supports the work W, and a cleaning unit 25 that cleans the discharging unit 21. As shown in FIG. 2, the discharging device 20 includes a posture changing unit 26 that changes a posture (position and angle) of the discharging unit 21, a pressure detection unit 27 that detects the pressure of a liquid supplied to the discharging unit 21, and a first control unit 51 that controls configuring members of the discharging device 20.

The discharging unit 21 has a cylinder 211 that has a cylindrical space therein, a seal member 214 that partitions the internal space of the cylinder 211 into a liquid chamber 212 and a gas chamber 213, a moving body 217 that partitions the gas chamber 213 into a first gas chamber 215 and a second gas chamber 216, and a coil spring 218 that is disposed in the second gas chamber 216. In addition, the discharging unit 21 has a first gas flow passage 221 that connects a gas supply source 11 supplying a gas having a pressure which is equal to or higher than the outside pressure (air having a pressure which is equal to or higher than the atmospheric pressure) and the first gas chamber 215 together, a second gas flow passage 222 that connects the gas supply source 11 and the second gas chamber 216 together, a first switching valve 223 provided in the first gas flow passage 221, and a second switching valve 224 provided in the second gas flow passage 222.

A nozzle 225 connected to the liquid chamber 212 is formed at a leading end of the cylinder 211. The internal space of the cylinder 211 is blocked from the outside air except for the nozzle 225 and connection parts to the first gas flow passage 221 and the second gas flow passage 222. Inside the cylinder 211, the liquid chamber 212 stores a liquid supplied from the supplying unit 23, and the first gas chamber 215 and the second gas chamber 216 store a gas supplied from the gas supply source 11.

The moving body 217 has a piston 226 having a disk shape and a stick-shaped rod 227 extending from the piston 226. The piston 226 moves in the gas chamber 213 according to a pressure difference between the first gas chamber 215 and the second gas chamber 216. The first gas chamber 215 is provided near the leading end of the cylinder 211, and the second gas chamber 216 is provided near a trailing end of the cylinder 211. A leading end of on the rod 227 on an opposite side to a base end connected to the piston 226 is formed in a hemispherical shape larger than an opening of the nozzle 225. The rod 227 moves in the internal space of the cylinder 211 with the piston 226 to close the nozzle 225 or to open the nozzle 225.

In the following description, the position of the moving body 217 when the leading end of the rod 227 closes the nozzle 225 and the liquid chamber 212 is blocked from the outside air is set as a "closed position", and the position of the moving body 217 when the leading end of the rod 227 opens the nozzle 225 and the liquid chamber 212 is connected to the outside air via the nozzle 225 is set as an "open position". That is, the moving body 217 moves between the closed position and the open position according to a pressure difference between the first gas chamber 215 and the second gas chamber 216.

The coil spring 218 pushes the piston 226 in a direction where the volume of the second gas chamber 216 increases. For this reason, in a case where a pressure difference is not generated between the first gas chamber 215 and the second gas chamber 216, the piston 226 comes into a moving state in a direction where the volume of the first gas chamber 215 decreases. In this case, the volume of the first gas chamber 215 becomes lowest, and the volume of the second gas chamber 216 becomes highest.

The first switching valve 223 is switched between a supply state where the first gas chamber 215 is connected to the gas supply source 11 and an open state where the first gas chamber 215 is connected to the outside air. Similarly, the second switching valve 224 is switched between a supply state where the second gas chamber 216 is connected to the gas supply source 11 and an open state where the second gas chamber 216 is connected to the outside air. The supply state is a state where a gas compressed to at the outside pressure or higher is supplied to the first gas chamber 215 or the second gas chamber 216. The open state is a state where the first gas chamber 215 or the second gas chamber 216 is open to the outside air. The gas supply source 11 may be, for example, air piping through which air compressed at the atmospheric pressure or higher flows and a compressor which supplies the air compressed at the atmospheric pressure or higher. In addition, the first switching valve 223 and the second switching valve 224 may be, for example, three-way solenoid valves.

In the discharging unit 21, when the first switching valve 223 switches from the supply state to the open state and the second switching valve 224 switches from the open state to the supply state, a gas flows out from the first gas chamber 215 while the gas flows into the second gas chamber 216. As a result, the pressure of the first gas chamber 215 becomes lower than the pressure of the second gas chamber 216, and the moving body 217 moves from the open position to the closed position. To be exact, when a force of a gas in the first gas chamber 215 pushing the piston 226 becomes smaller than a force of a gas in the second gas chamber 216 and the coil spring 218 pushing the piston 226, the moving body 217 moves from the open position to the closed position.

On the contrary, in the discharging unit 21, when the first switching valve 223 is switched from the open state to the supply state and the second switching valve 224 is switched from the supply state to the open state, a gas flows into the first gas chamber 215 while the gas flows out from the second gas chamber 216. As a result, the pressure of the first gas chamber 215 becomes higher than the pressure of the second gas chamber 216, and the moving body 217 moves from the closed position to the open position. To be exact, when a force of a gas in the first gas chamber 215 pushing the piston 226 becomes larger than a force of a gas in the second gas chamber 216 and the coil spring 218 pushing the piston 226, the moving body 217 moves from the closed position to the open position.

The supplying unit 23 has a liquid supply source 231, which is a supply source of a liquid, a liquid flow passage 232 that connects the liquid supply source 231 and the discharging unit 21 together, and a reciprocating pump 233 that intermittently supplies a liquid from the liquid supply source 231 to the discharging unit 21. In addition, the supplying unit 23 has an accumulator 234 that prevents pressure fluctuations of a liquid in the liquid flow passage 232 and a regulator 235 that regulates the pressure of the liquid in the liquid flow passage 232.

The liquid supply source 231 may be a container storing a liquid. The liquid supply source 231 may be an open container with respect to the outside air, or may be a closed container with respect to the outside air. The reciprocating pump 233 may be a piston, a piston pump that supplies a liquid by reciprocation of a plunger and a diaphragm, a plunger pump, or a diaphragm pump. For this reason, when supplying a liquid, the reciprocating pump 233 repeats a suction step of mainly sucking a liquid from the liquid supply source 231 and a discharging step of mainly discharging the liquid toward the discharging unit 21. By the driving of the reciprocating pump 233, the pressure of a liquid flowing in the liquid flow passage 232 and the pressure of a liquid stored in the liquid chamber 212 of the discharging unit 21 become equal to or higher than the outside pressure.

The cleaning unit 25 includes a nozzle accommodating unit 251 having a recessed shape along the shape of the nozzle 225 of the discharging unit 21, a waste liquid flow passage 252 having one end connected to the nozzle accommodating unit 251, and a suction pump 253 connected to the other end of the waste liquid flow passage 252. As illustrated in FIG. 1, in a state where the nozzle 225 is accommodated in the nozzle accommodating unit 251, the cleaning unit 25 drives the suction pump 253 to generate a negative pressure in the nozzle accommodating unit 251. In this manner, the cleaning unit 25 sucks and removes a foreign substance attached to the nozzle 225.

In the following description, the position of the discharging unit 21 when the nozzle 225 of the discharging unit 21 is accommodated in the nozzle accommodating unit 251 is also referred to as a "cleaning position". The position of the discharging unit 21 when the nozzle 225 of the discharging unit 21 faces the supporting unit 24 or the work W supported by the supporting unit 24 is also referred to as a "discharging position".

The pressure detection unit 27 may be provided in the liquid flow passage 232 as illustrated in FIG. 1, or may be provided in the liquid chamber 212. The pressure detection unit 27 may be configured to be capable of detecting the pressure of a liquid supplied to the liquid chamber 212 of the discharging unit 21 or a pressure equivalent to this pressure.

The first control unit 51 (control unit 50) controls the posture changing unit 26 to change the posture of the discharging unit 21 with respect to the work W supported by the supporting unit 24. That is, the first control unit 51 changes a position and an angle of the discharging unit 21 such that a region of the work W to which a liquid is to be attached is located in a direction where the nozzle 225 of the discharging unit 21 faces. After then, the first control unit 51 acquires the pressure of a liquid supplied to the liquid chamber 212 of the discharging unit 21 (hereinafter, also referred to as a "detected pressure Pd") based on detection results from the pressure detection unit 27. Then, the first control unit 51 approves or limits liquid discharging by the discharging unit 21 based on the detected pressure Pd.

In a case of discharging a liquid, the first control unit 51 switches between the states of the first switching valve 223 and the states of the second switching valve 224 respectively, and moves the moving body 217 from the closed position to the open position only for a short time. Then, the liquid chamber 212 of the discharging unit 21 storing a liquid at a pressure that is equal to or higher than the outside pressure is connected to the outside air only for a short time. As a result, the liquid stored in the liquid chamber 212 is discharged as droplets via the nozzle 225 due to a pressure difference between the liquid chamber 212 and the outside air.

In addition, the first control unit 51 drives the reciprocating pump 233 to supply a liquid from the liquid supply source 231 to the discharging unit 21. At this time, the first control unit 51 controls the supply amount of a liquid in the discharging step of the reciprocating pump 233 so as to supplement a liquid amount consumed per unit time by the discharging unit 21 discharging the liquid. A liquid amount supplied by the reciprocating pump 233 in one time of the discharging step is extremely large compared to a liquid amount discharged by the discharging unit 21 all at once.

Next, the temperature regulating device 30 will be described.

As illustrated in FIGS. 1 and 2, the temperature regulating device 30 includes a first temperature regulating unit 31 that regulates the temperature of a liquid supplied to the liquid chamber 212 of the discharging unit 21, a second temperature regulating unit 32 that regulates the temperature of the first temperature regulating unit 31, which is an example of a temperature regulation target, and a second control unit 52 that controls the first temperature regulating unit 31 and the second temperature regulating unit 32.

The first temperature regulating unit 31 is a so-called Peltier element. The plurality (two, in the embodiment) of first temperature regulating units 31 are provided so as to cover a part of the cylinder 211 of the discharging unit 21. In the first temperature regulating unit 31, a first face 311 confronts a wall portion configuring the liquid chamber 212 of the cylinder 211 of the discharging unit 21, and a second face 312 confronts the second temperature regulating unit 32. Due to a direction where a current flows, the temperature of one face, out of the first face 311 and the second face 312 of the first temperature regulating unit 31, rises, and the temperature of the other face declines.

The second temperature regulating unit 32 has a first storing chamber 321 and a second storing chamber 322, which store a heat medium, a heat medium flow passage 323 which connects the first storing chamber 321 and the second storing chamber 322 together, and a heat exchanging member 324 which exchanges heat with the first temperature regulating unit 31. In addition, the second temperature regulating unit 32 has a third gas flow passage 325 having one end connected to the first storing chamber 321, a fourth gas flow passage 326 having one end connected to the second storing chamber 322, a third switching valve 327 connected to the other end of the third gas flow passage 325 and the other end of the fourth gas flow passage 326, and a fifth gas flow passage 328 connecting the third switching valve 327 and the gas supply source 11 together. The second temperature regulating unit 32 has a first heat medium amount detection unit 331 that detects the heat medium amount of the first storing chamber 321, a second heat medium amount detection unit 332 that detects the heat medium amount of the second storing chamber 322, and a temperature detection unit 333 that detects the temperature of a liquid stored in the liquid chamber 212 of the discharging unit 21.

The first storing chamber 321 is blocked from the outside air except for connection parts to the heat medium flow passage 323 and the third gas flow passage 325. The second storing chamber 322 is blocked from the outside air except for connection parts to the heat medium flow passage 323 and the fourth gas flow passage 326. In the embodiment, the volume of the first storing chamber 321 and the volume of the second storing chamber 322 are substantially the same. In addition, it is preferable that the first storing chamber 321 and the second storing chamber 322 be made of a material having a high thermal conductivity such as a metal. In this case, the first storing chamber 321 and the second storing chamber 322 may have a configuration such as a fin for improving the efficiency of heat exchange with the outside air. A heat medium stored in the first storing chamber 321 and the second storing chamber 322 may be a liquid such as water and oil, or may be a gas.

The plurality (two in the embodiment) of heat exchanging members 324 are provided so as to cover the first temperature regulating units 31. The heat exchanging member 324 is made of a material having a high thermal conductivity such as a metal, and a part of the heat medium flow passage 323 is provided therein. It is preferable that the heat medium flow passage 323 be meandered or branch off into a plurality of capillaries inside the heat exchanging member 324 in order to improve the efficiency of heat exchange. In this respect, in the embodiment, the heat medium flow passage 323 is provided so as to be capable of exchanging heat with the first temperature regulating unit 31, which is an example of the temperature regulation target.

The third switching valve 327 is a solenoid valve that switches connection states between the first storing chamber 321 or the second storing chamber 322 and the outside air or the gas supply source 11. Specifically, the third switching valve 327 switches among three states including a first state where the first storing chamber 321 is connected to the gas supply source 11 and the second storing chamber 322 is connected to the outside air, a second state where the first storing chamber 321 is connected to the outside air and the second storing chamber 322 is connected to the gas supply source 11, and a third state where both of the first storing chamber 321 and the second storing chamber 322 are connected to the outside air.

The first state is a state where a gas compressed at the outside pressure or higher is supplied to the first storing chamber 321 connected to the gas supply source 11 while the second storing chamber 322 is opened to the outside air. The second state is a state where a gas compressed at the outside pressure or higher is supplied to the second storing chamber 322 connected to the gas supply source 11 while the first storing chamber 321 is opened to the outside air. The third state is a state where both of the first storing chamber 321 and the second storing chamber 322 are opened to the outside air.

For this reason, in a case where the third switching valve 327 is switched to the first state, a heat medium of the first storing chamber 321 is transported to the second storing chamber 322 via the heat medium flow passage 323 since the first storing chamber 321 has a higher pressure than the second storing chamber 322 does. In a case where the third switching valve 327 is switched to the second state, a heat medium of the second storing chamber 322 is transported to the first storing chamber 321 via the heat medium flow passage 323 since the second storing chamber 322 has a higher pressure than the first storing chamber 321 does. In a case where the third switching valve 327 is switched to the third state, a heat medium does not flow in the heat medium flow passage 323 since a pressure difference between the first storing chamber 321 and the second storing chamber 322 disappears.

In this respect, in the embodiment, the third gas flow passage 325, the fourth gas flow passage 326, the third switching valve 327, and the fifth gas flow passage 328 correspond to an example of a "pressure regulating unit" that generates a pressure difference between the heat medium of the first storing chamber 321 and the heat medium of the second storing chamber 322, and the third switching valve 327 corresponds to an example of a "switching valve".

It is not necessary to configure the third switching valve 327 with one switching valve. For example, the third switching valve 327 may be configured by a switching valve switching connection points of the first storing chamber 321 to the outside air or the gas supply source 11 and a switching valve switching connection points of the second storing chamber 322 to the outside air or the gas supply source 11.

For example, in a case where a heat medium is a liquid, the first heat medium amount detection unit 331 and the second heat medium amount detection unit 332 may be level sensors detecting a liquid level of the heat medium. In the following description, heat medium amounts in the first storing chamber 321 and the second storing chamber 322, which are stored heat medium amounts that have decreased, are set as a first specified amount VL1*th* and a second specified amount VL2*th* respectively. For example, the first specified amount VL1*th* and the second specified amount VL2*th* may be amounts that are approximately 10% of the volume of the first storing chamber 321 and the volume of the second storing chamber 322 respectively. Since the volume of the first storing chamber 321 and the volume of the second storing chamber 322 are the same in the embodiment, the first specified amount VL1*th* and the second specified amount VL2*th* are also set to the same value.

In the embodiment, the second temperature regulating unit 32 transports a heat medium between the first storing chamber 321 and the second storing chamber 322. Therefore, in a case where the heat medium amount of one storing chamber becomes large, the heat medium amount of the other storing chamber becomes small. For this reason, when the heat medium amount of the first storing chamber 321 becomes approximately the first specified amount VL1*th*, it is preferable to determine a total amount of a heat medium handled by the second temperature regulating unit 32 such that the heat medium amount of the second storing chamber 322 becomes approximately a maximum amount.

The temperature detection unit 333 may be configured to directly or indirectly detect the temperature of a liquid stored in the liquid chamber 212 of the discharging unit 21. For example, the temperature detection unit 333 may be configured to detect a temperature equivalent to the temperature of a liquid stored in the liquid chamber 212 of the discharging unit 21 by detecting the temperature of the vicinity of the nozzle 225 of the discharging unit 21.

The second control unit 52 acquires the temperature of a liquid stored in the liquid chamber 212 of the discharging unit 21 (hereinafter, also referred to as a "detected temperature") based on detection results from the temperature detection unit 333. Then, the second control unit 52 drives the first temperature regulating unit 31 such that the temperature of the first face 311 confronting the discharging unit 21 increases in a case where the detected temperature is lower than a set temperature, and drives the first temperature regulating unit 31 such that the temperature of the first face 311 confronting the discharging unit 21 decreases in a case where the detected temperature is higher than the set temperature.

In the following description, driving the first temperature regulating unit 31 in order to heat a liquid stored in the liquid chamber 212 of the discharging unit 21 is also referred to as "heat-driving". Driving the first temperature regulating unit 31 in order to cool the liquid stored in the liquid chamber 212 of the discharging unit 21 is also referred to as "cool-driving". In addition, the set temperature is the temperature of a liquid when the liquid can be normally discharged from the discharging unit 21, and is a temperature determined in advance through experiments or the like.

Meanwhile, in a case of heat-driving the first temperature regulating unit 31, the temperature of the second face 312 gradually decreases. In a case of cool-driving the first temperature regulating unit 31, the temperature of the second face 312 gradually increases. For this reason, when the first temperature regulating unit 31 is continued to be driven, heat is transmitted from a high-temperature face to a low-temperature face, out of the first face 311 and the second face 312. Thus, the heating efficiency and the cooling efficiency of the first temperature regulating unit 31 are likely to decline.

Thus, in a case of driving the first temperature regulating unit 31, the second control unit 52 drives the second temperature regulating unit 32 as well. That is, in the case of driving the first temperature regulating unit 31, the second control unit 52 causes the third switching valve 327 to switch between the first state and the second state, and a heat medium is transported between the first storing chamber 321 and the second storing chamber 322. In this manner, the second temperature regulating unit 32 prevents an excessive decrease in the temperature of the second face 312 in the case of heat-driving the first temperature regulating unit 31, and prevents an excessive increase in the temperature of the second face 312 in the case of cool-driving the first temperature regulating unit 31.

Next, the inspection device 40 will be described.

As illustrated in FIG. 1, the inspection device 40 includes a pair of extension plates 41, which extends from the leading end of the cylinder 211 of the discharging unit 21, a first object detection unit 42 and a second object detection unit 43, which are disposed on one of the extension plates 41, and a reflecting plate 44 which is disposed on the other of the extension plates 41. In addition, as shown in FIG. 2, the inspection device 40 includes a notifying unit 45 which gives notice of a liquid discharging state of the discharging unit 21 and a third control unit 53 which controls configuring members of the inspection device 40.

The pair of extension plates 41 is provided at an interval in a direction orthogonal to an axis AX of the opening of the nozzle 225 of the discharging unit 21. The pair of extension plates 41 is provided such that the nozzle 225 of the discharging unit 21 is located therebetween.

The first object detection unit 42 has a first light emitting unit 421 that emits laser light such that the laser light passes through a first position P1, which is a position on the axis AX of the opening of the nozzle 225, and a first light receiving unit 422 that receives the laser light emitted by the first light emitting unit 421. The second object detection unit 43 has a second light emitting unit 431 that emits laser light such that the laser light passes through a second position P2, which is a position on the axis AX of the opening of the nozzle 225, and a second light receiving unit 432 that receives the laser light emitted by the second light emitting unit 431.

The first position P1 is a position immediately below the nozzle 225 in a liquid discharging direction of the discharging unit 21, and the second position P2 is a position that is separated further apart from the nozzle 225 than the first position P1 is. The first light emitting unit 421 and the second light emitting unit 431 emit laser light in a direction intersecting (orthogonal to) the axis AX of the opening of the nozzle 225. The first light receiving unit 422 receives light reflected by the reflecting plate 44, which is laser light emitted by the first light emitting unit 421. The second light receiving unit 432 receives light reflected by the reflecting plate 44, which is laser light emitted by the second light emitting unit 431.

That is, in a case where an object is present at the first position P1, the laser light emitted by the first light emitting unit 421 is blocked by this object, and the light received amount of the first light receiving unit 422 changes. Similarly, in a case where an object is present at the second position P2, the laser light emitted by the second light emitting unit 431 is blocked by this object, and the light received amount of the second light receiving unit 432 changes. In this manner, in the embodiment, the first object detection unit 42 and the second object detection unit 43 configure a reflective optical sensor. Each of the first object detection unit 42 and the second object detection unit 43 may be a transmissive optical sensor.

It is preferable to change the beam diameter of laser light, which is emitted by the first light emitting unit 421, at the first position P1 and the beam diameter of laser light, which is emitted by the second light emitting unit 431, at the second position P2 according to the size of a liquid discharged from the discharging unit 21.

The first object detection unit 42 detects the presence or absence of an object at the first position P1 based on the light received amount of the first light receiving unit 422. The second object detection unit 43 detects the presence or absence of an object at the second position P2 based on the light received amount of the second light receiving unit 432. In the embodiment, the first object detection unit 42 and the second object detection unit 43 correspond to an example of an "observation unit" that observes a liquid discharged from the nozzle 225.

The notifying unit 45 may be, for example, a device capable of outputting light or sound, such as a liquid crystal panel, a warning light, and a buzzer, or may be a device outputting data such as a log file. It is sufficient that the notifying unit 45 can give notice of abnormal discharging at least in a case where a liquid has not been normally discharged from the discharging unit 21.

The third control unit 53 acquires timings when a liquid discharged from the discharging unit 21 passes through the first position P1 and the second position P2 based on detection results from the first object detection unit 42 and the second object detection unit 43. Then, the third control unit 53 calculates the speed of the liquid discharged from the discharging unit 21 (hereinafter, also referred to as "detected speed Vd") based on the timings when the liquid discharged from the discharging unit 21 passes through the first position P1 and the second position P2 and a distance from the first position P1 to the second position P2. Based on the calculated detected speed Vd, the third control unit 53 determines whether or not the liquid has been normally discharged from the discharging unit 21, or determines whether or not it is a state where a liquid can be normally discharged from the discharging unit 21.

Next, the flow of processing executed by the control unit 50 (first control unit 51) in order to determine whether or not liquid discharging is possible will be described with reference to a flow chart shown in FIG. 3. The processing is processing executed for each predetermined control cycle.

Figure 3:
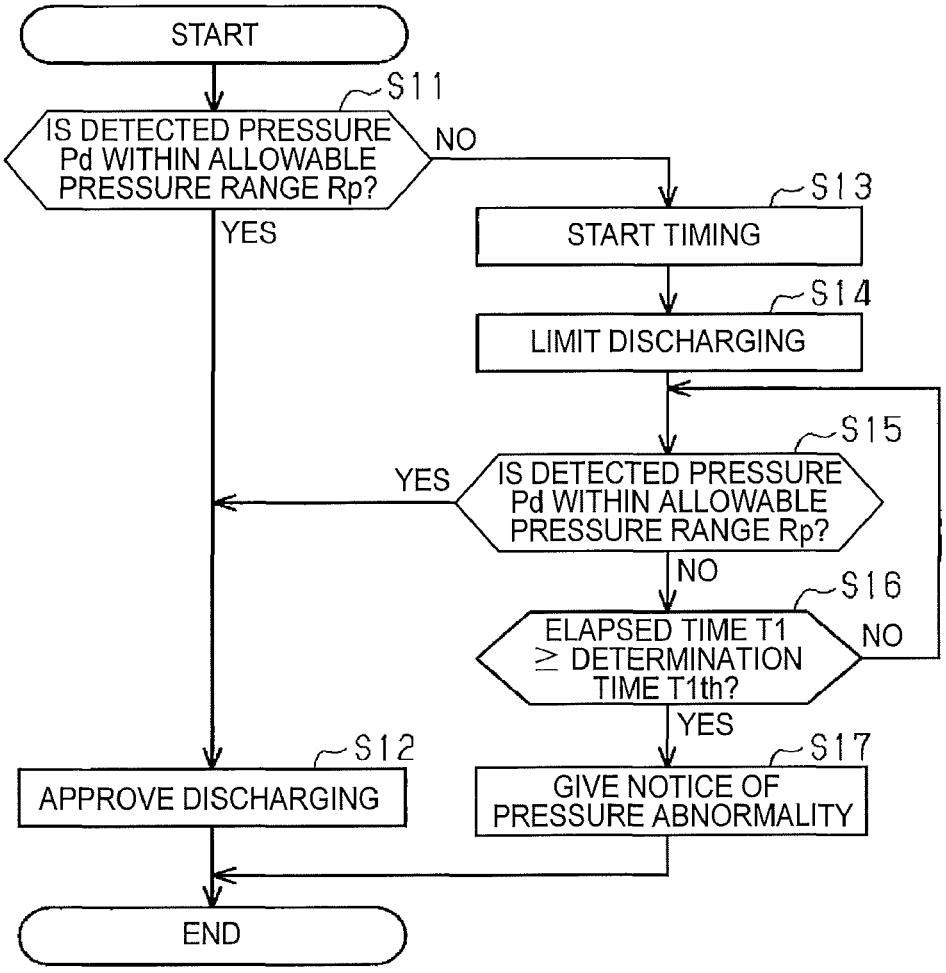
FIG. 3 is a flow chart showing flow of processing executed by a control unit when determining whether or not a discharging unit can normally discharge a liquid.

As shown in FIG. 3, the control unit 50 determines whether or not the detected pressure Pd acquired based on detection results from the pressure detection unit 27 falls within an allowable pressure range Rp (Step S11). The allowable pressure range Rp is a pressure range where liquid discharging by the discharging unit 21 is suitable. It is preferable to acquire the allowable pressure range in advance through experiments or the like. In addition, it is preferable to change the allowable pressure range Rp according to the type of a liquid to be discharged and the temperature of a liquid.

In a case where the detected pressure Pd falls within the allowable pressure range Rp (Step S11: YES), the control unit 50 approves liquid discharging (Step S12), and terminates the processing. On the contrary, in a case where the detected pressure Pd does not fall within the allowable pressure range Rp (Step S11: NO), the control unit 50 starts timing of an elapsed time T1 since the negative determination in the processing of Step S11 (Step S13). Next, the control unit 50 limits liquid discharging by the discharging unit 21 (Step S14). After then, the control unit 50 again determines whether or not the detected pressure Pd falls within the allowable pressure range Rp (Step S15).

In a case where the detected pressure Pd falls within the allowable pressure range Rp (Step S15: YES), the control unit 50 takes the processing to previous Step S12. On the contrary, in a case where the detected pressure Pd does not fall within the allowable pressure range Rp (Step S15: NO), the control unit 50 determines whether or not the elapsed time T1 since the negative determination in the processing of Step S11 is equal to or longer than a predetermined determination time T1*th* (Step S16).

In a case where the elapsed time T1 falls short of the determination time T1*th* (Step S16: NO), the control unit 50 takes the processing to previous Step S15. On the contrary, in a case where the elapsed time T1 is equal to or longer than the determination time T1*th* (Step S16: YES), the control unit 50 causes the notifying unit 45 to give notice of an abnormality of the pressure of a liquid supplied to the liquid chamber 212 of the discharging unit 21 (Step S17). After that, the control unit 50 terminates the processing.

In the processing described above, even when the detected pressure Pd does not fall within the allowable pressure range Rp, the control unit 50 does not cause the notifying unit 45 to give notice of a pressure abnormality of the liquid chamber 212 of the discharging unit 21 until the determination time T1*th* elapses. For this reason, even when the detected pressure Pd fluctuates (pulsates) only for a short time in a case where the suction step and the discharging step performed by the reciprocating pump 233 of the supplying unit 23 are switched, the control unit 50 does not cause the notifying unit to give notice of a pressure abnormality of the liquid chamber 212. In this respect, the determination time T1*th* may be determined according to a time taken for performing the suction step and the discharging step of the reciprocating pump 233.

Next, the flow of processing executed by the control unit 50 (first control unit 51) when discharging a liquid will be described with reference to a flow chart shown in FIG. 4. The processing is processing executed in a case where liquid discharging is approved.

Figure 4:
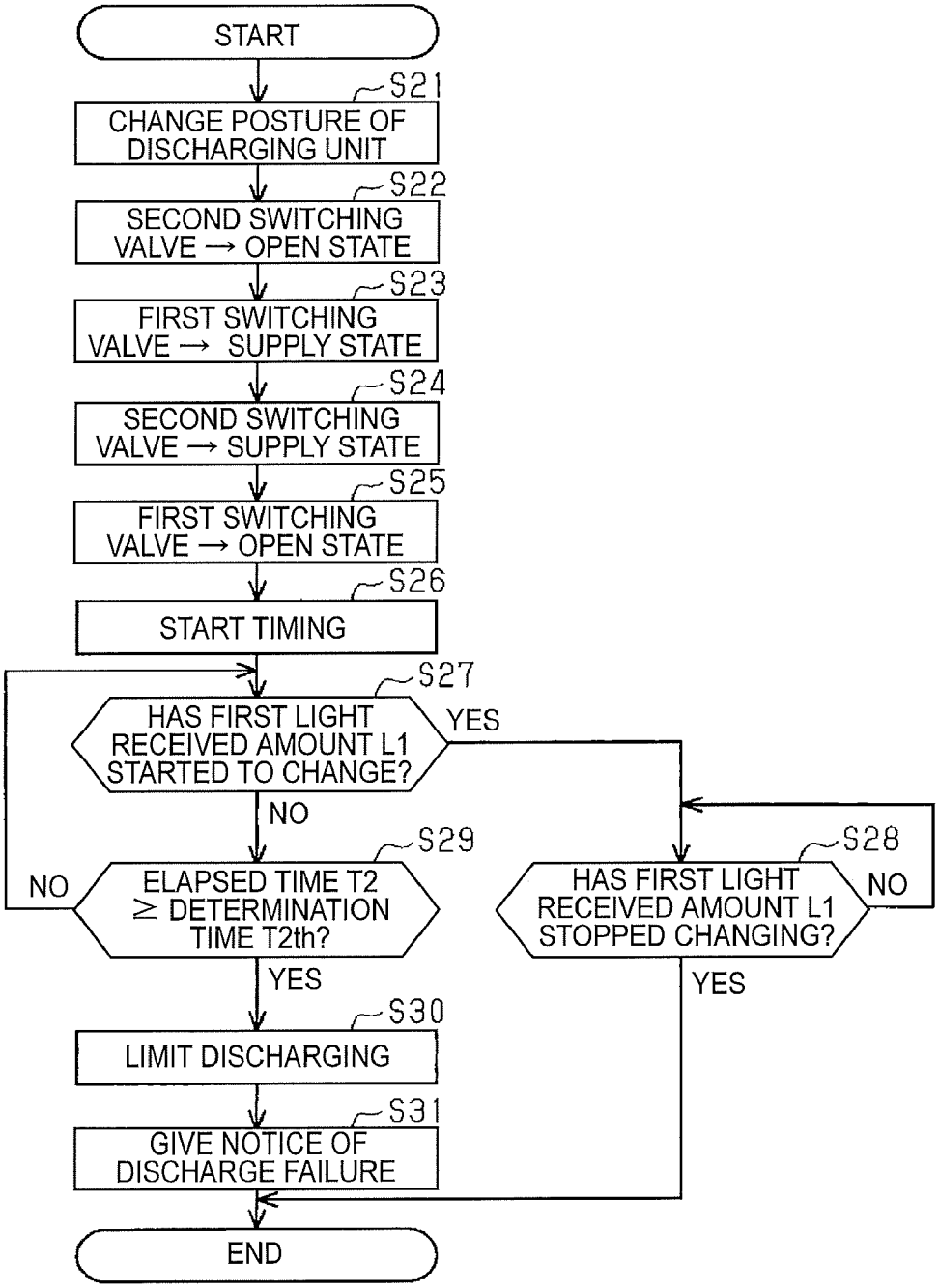
FIG. 4 is a flow chart showing flow of processing executed by the control unit when the discharging unit discharges the liquid.

As shown in FIG. 4, the control unit 50 drives the posture changing unit 26 and changes the posture of the discharging unit 21 (Step S21). Specifically, the control unit 50 changes the posture of the discharging unit 21 such that a part of the work W to which a liquid is to be attached is located in the direction where the nozzle 225 of the discharging unit 21 faces.

Next, the control unit 50 switches the second switching valve 224 to the open state (Step S22), and connects the second gas chamber 216 of the discharging unit 21 to the outside air. That is, the control unit 50 sets both of the pressures of the first gas chamber 215 and the second gas chamber 216 of the discharging unit 21 to the outside pressure. After then, the control unit 50 switches the first switching valve 223 to the supply state (Step S23), and connects the first gas chamber 215 of the discharging unit 21 to the gas supply source 11. That is, the control unit 50 makes the pressure of the first gas chamber 215 of the discharging unit 21 higher than the pressure of the second gas chamber 216. As a result, the moving body 217 moves from the closed position to the open position. In this respect, in the embodiment, when moving the moving body 217 from the closed position to the open position, the switching of the first switching valve 223 and the switching of the second switching valve 224 are performed at different timings.

Next, the control unit 50 switches the second switching valve 224 to the supply state (Step S24), and connects the second gas chamber 216 to the gas supply source 11. That is, the control unit 50 sets both of the pressures of the first gas chamber 215 and the second gas chamber 216 of the discharging unit 21 to a pressure according to the pressure of a gas supplied from the gas supply source 11. Then, the control unit 50 switches the first switching valve 223 to the open state (Step S25), and connects the first gas chamber 215 to the outside air. That is, the control unit 50 makes the pressure of the first gas chamber 215 of the discharging unit 21 lower than the pressure of the second gas chamber 216. As a result, the moving body 217 moves from the open position to the closed position. In this respect, in the embodiment, when moving the moving body 217 from the open position to the closed position, the switching of the first switching valve 223 and the switching of the second switching valve 224 are performed at different timings.

It is preferable to execute Step S24 before the moving body 217 starts moving from the open position to the closed position due to the execution of Step S23. That is because the piston 226 may start being displaced in a direction where the volume of the first gas chamber 215 decreases due to the effect of the coil spring 218 when a pressure difference between the first gas chamber 215 and the second gas chamber 216 of the discharging unit 21 becomes 0 (zero) by switching the second switching valve 224 to the supply state in Step S23. In other words, that is because the moving body 217 starts moving from the open position to the closed position at a timing when the processing of Step S24 starts.

Next, the control unit 50 starts timing of an elapsed time T2 since the execution of Step S25 (Step S26). Then, the control unit 50 determines whether or not a first light received amount L1, which is the light received amount of the first light receiving unit 422, has started to change based on detection results from the first light receiving unit 422 (Step S27). In a case where the first light received amount L1 has started to change (Step S27: YES), that is, in a case where a liquid discharged from the discharging unit 21 has started to pass through the first position P1, the control unit 50 determines whether or not the first light received amount L1 has stopped changing (Step S28). In a case where the first light received amount L1 is changing (Step S28: NO), that is, in a case where a liquid discharged from the discharging unit 21 is in the middle of passing through the first position P1, the control unit 50 again executes the processing of Step S28. In a case where the first light received amount L1 has stopped changing (Step S28: YES), that is, in a case where a liquid discharged from the discharging unit 21 has finished passing through the first position P1, the control unit 50 terminates the processing.

In a case where the first light received amount L1 has not started to change in previous Step S27 (Step S27: NO), that is, in a case where a liquid which should have been discharged by the discharging unit 21 does not reach the first position P1, the control unit 50 determines whether or not the elapsed time T2 since the processing of Step S25 is finished being executed is equal to or longer than a determination time T2*th* (Step S29). In a case where the elapsed time T2 falls short of the determination time T2*th* (Step S29: NO), the control unit 50 takes the processing to previous Step S27. In a case where the elapsed time T2 is equal to or longer than the determination time T2*th* (Step S29: YES), that is, in a case where the liquid which should have been discharged by the discharging unit 21 does not reach the first position P1, the control unit 50 limits discharging by the discharging unit 21 (Step S30), and causes the notifying unit 45 to give notice of a liquid discharge failure of the discharging unit 21 (Step S31). After then, the control unit 50 terminates the processing.

In the processing described above, if a liquid discharged by the discharging unit 21 does not pass through the first position P1, the discharging unit 21 cannot discharge the next liquid. In addition, if a liquid discharged by the discharging unit 21 does not reach the first position P1, the next liquid discharging by the discharging unit 21 is limited and notice of a discharge failure is given.

Next, the flow of processing executed by the control unit 50 (first control unit 51) in a case where liquid discharging by the discharging unit 21 is limited due to the occurrence of a discharge failure or the occurrence of dripping from the nozzle 225 will be described with reference to a flow chart shown in FIG. 5.

Figure 5:
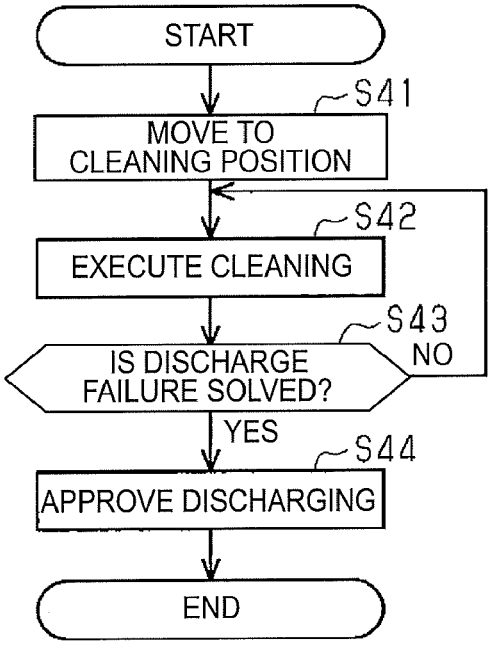
FIG. 5 is a flow chart showing flow of processing executed by the control unit when the discharging unit performs cleaning.

As shown in FIG. 5, the control unit 50 drives the posture changing unit 26 and moves the discharging unit 21 to the cleaning position (Step S41). Next, the control unit 50 executes cleaning of the nozzle 225 of the discharging unit 21 (Step S42) to remove a liquid and foreign substances attached to the opening of the nozzle 225. After then, the control unit 50 determines whether or not a liquid discharge failure of the discharging unit 21 has been solved (Step S43). Whether or not the discharge failure of the discharging unit 21 has been solved may be determined, for example, based on the speed of a liquid when discharging this liquid to the nozzle accommodating unit 251, or may be visually determined by a user of the discharging apparatus 10. In a case where the discharge failure is not solved (Step S43: NO), the control unit 50 takes the processing to previous Step S42. On the contrary, in a case where the discharge failure is solved (Step S43: YES), the control unit 50 approves liquid discharging by the discharging unit 21 (Step S44), and terminates the processing.

Next, the content of processing executed by the control unit 50 (second control unit 52) in order to reciprocate a heat medium between the first storing chamber 321 and the second storing chamber 322 will be described with reference to a flow chart shown in FIG. 6. The processing is processing executed when driving the first temperature regulating unit 31.

Figure 6:
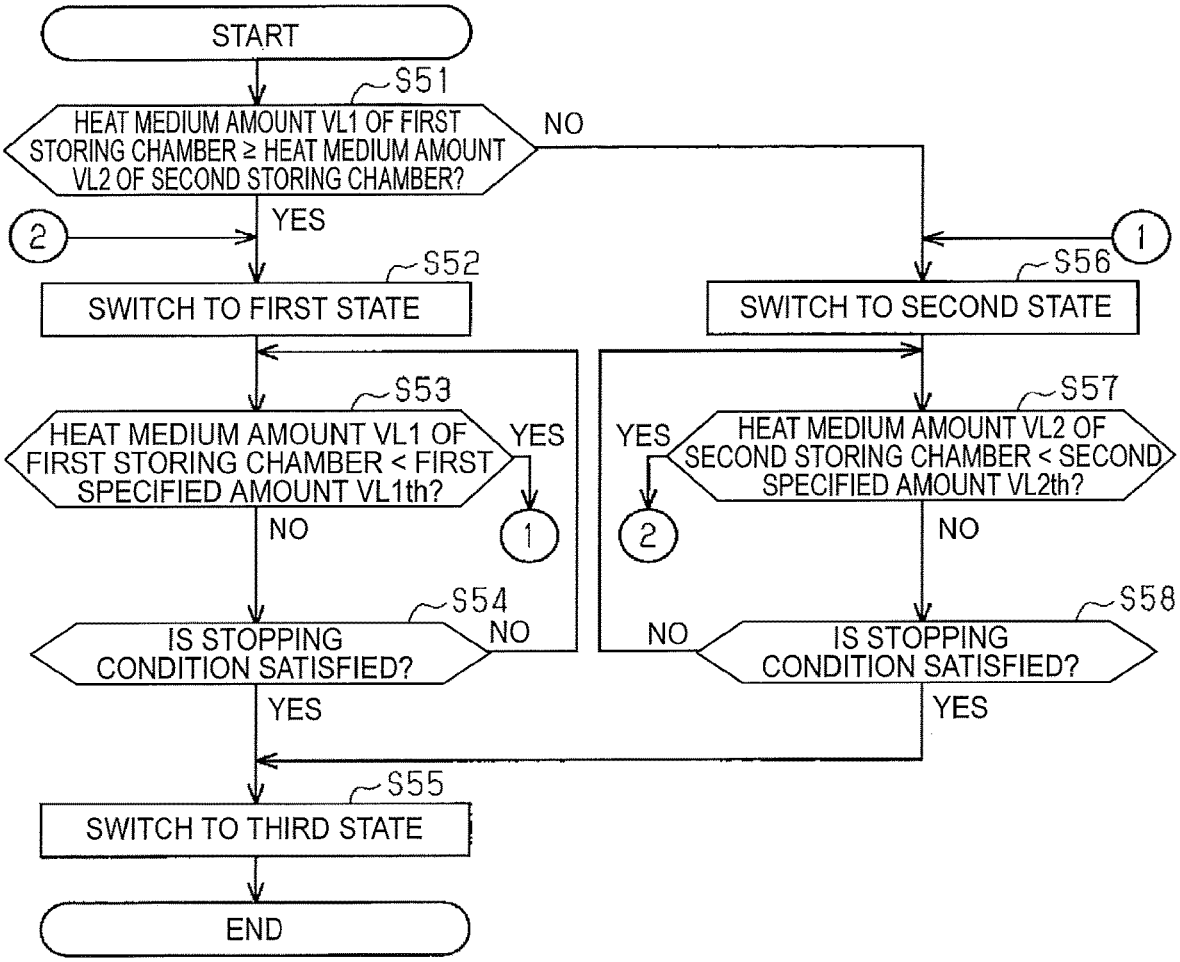
FIG. 6 is a flow chart showing flow of processing executed by the control unit when driving a second temperature regulating unit.

As shown in FIG. 6, the control unit 50 determines whether or not a heat medium amount VL1 of the first storing chamber 321 is equal to or larger than a heat medium amount VL2 of the second storing chamber 322 (Step S51). In a case where the heat medium amount VL1 of the first storing chamber 321 is equal to or larger than the heat medium amount VL2 of the second storing chamber 322 (Step S51: YES), the control unit 50 switches the third switching valve 327 to the first state, which is a state where a liquid is transported from the first storing chamber 321 to the second storing chamber 322 (Step S52). Next, the control unit 50 determines whether or not the heat medium amount VL1 of the first storing chamber 321 falls short of the first specified amount VL1*th* (Step S53). In a case where the heat medium amount VL1 of the first storing chamber 321 falls short of the first specified amount VL1*th* (Step S53: YES), that is, in a case where a liquid cannot be continued to be transported from the first storing chamber 321 to the second storing chamber 322, the control unit 50 takes the processing to Step S56 to be described later.

In a case where the heat medium amount VL1 of the first storing chamber 321 is equal to or larger than the first specified amount VL1*th* (Step S53: NO), that is, in a case where a liquid can be continued to be transported from the first storing chamber 321 to the second storing chamber 322, the control unit 50 determines whether or not a stopping condition for stopping the transportation of a liquid is satisfied (Step S54). In a case where the stopping condition is not satisfied (Step S54: NO), the control unit 50 takes the processing to previous Step S53. In a case where the stopping condition is satisfied (Step S54: YES), the control unit 50 switches the third switching valve 327 to the third state, which is a state where a liquid is stopped being transported between the first storing chamber 321 and the second storing chamber 322 (Step S55), and terminates the processing. The stopping condition is a condition that is satisfied, for example, in a case where temperature regulation of the first temperature regulating unit 31 is not necessary, such as a case where the driving of the first temperature regulating unit 31 is stopped.

In a case where the heat medium amount VL1 of the first storing chamber 321 falls short of the heat medium amount VL2 of the second storing chamber 322 (Step S51: NO) in previous Step S51, the control unit 50 switches the third switching valve 327 to the second state, which is a state where a liquid is transported from the second storing chamber 322 to the first storing chamber 321 (Step S56). Next, the control unit 50 determines whether or not the heat medium amount VL2 of the second storing chamber 322 falls short of the second specified amount VL2*th* (Step S57). In a case where the heat medium amount VL2 of the second storing chamber 322 falls short of the second specified amount VL2*th* (Step S57: YES), that is, in a case where a liquid cannot be continued to be transported from the second storing chamber 322 to the first storing chamber 321, the control unit 50 takes the processing to previous Step S52.

In a case where the heat medium amount VL2 of the second storing chamber 322 is equal to or larger than the second specified amount VL2*th* (Step S57: NO), that is, in a case where a liquid can be continued to be transported from the second storing chamber 322 to the first storing chamber 321, the second control unit 52 determines whether or not the condition for stopping the transportation of a liquid is satisfied (Step S58). In a case where the stopping condition is not satisfied (Step S58: NO), the control unit 50 takes the processing to previous Step S57. In a case where the stopping condition is satisfied (Step S58: YES), the control unit 50 takes the processing to Step S55.

Next, the flow of processing executed by the third control unit 53 (control unit 50) will be described with reference to a flow chart shown in FIG. 7. The processing is processing executed when the discharging device 20 discharges a liquid.

Figure 7:
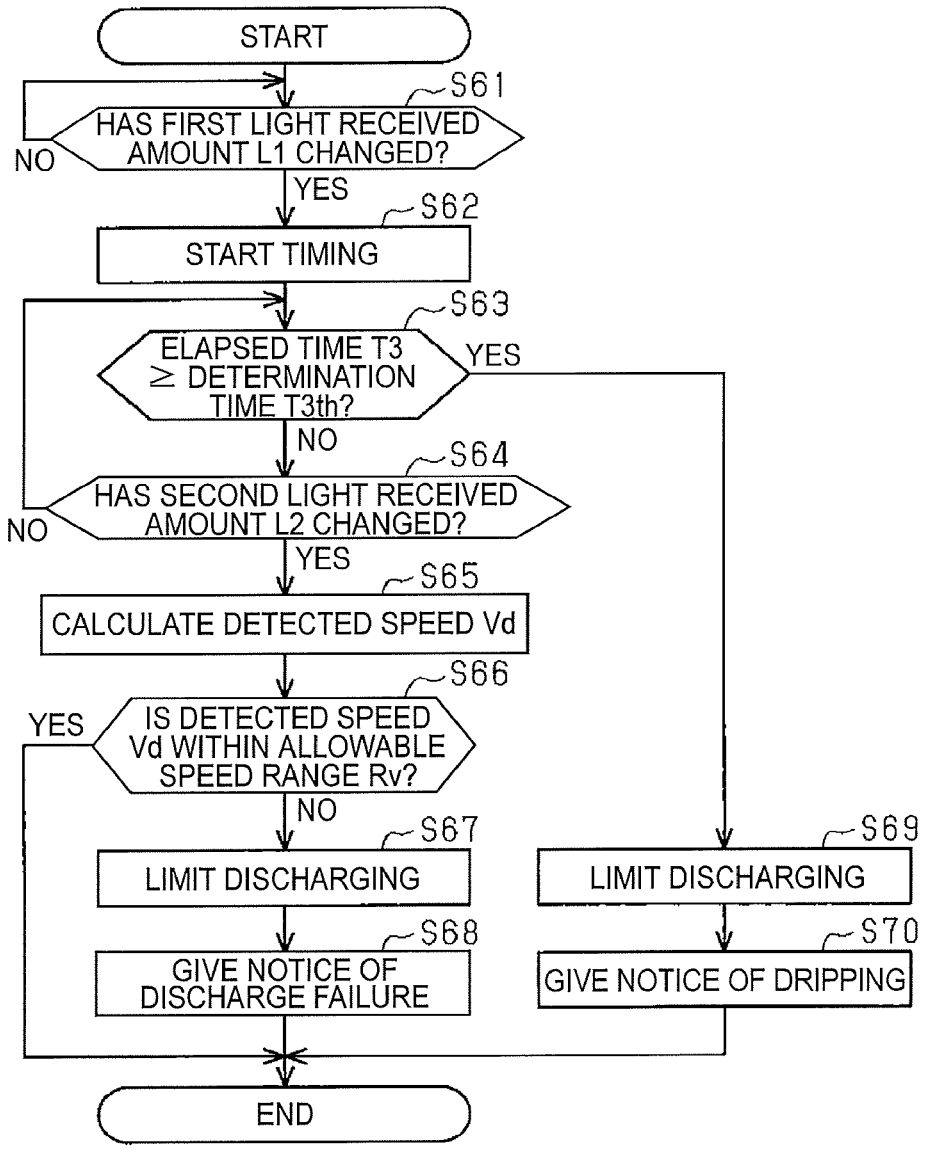
FIG. 7 is a flow chart showing flow of processing executed by the control unit when determining whether or not the discharging unit has normally discharged the liquid.

As shown in FIG. 7, the control unit 50 determines whether or not the first light received amount L1 has changed based on detection results from the first object detection unit 42 (first light receiving unit 422) (Step S61). In a case where the first light received amount L1 has not changed (Step S61: NO), that is, in a case where a liquid discharged by the discharging unit 21 does not reach the first position P1, the control unit 50 again executes the processing of Step S61. In a case where the first light received amount L1 has changed (Step S61: YES), that is, in a case where a liquid discharged by the discharging unit 21 reaches the first position P1, the control unit 50 starts timing of an elapsed time T3 since the positive determination in the processing of Step S61 (Step S62).

Then, the control unit 50 determines whether or not the elapsed time T3 since the positive determination in the processing of Step S61 is equal to or longer than a determination time T3*th* (Step S63). In a case where the elapsed time T3 falls short of the determination time T3*th* (Step S63: NO), the control unit 50 determines whether or not a second light received amount L2, which is the light received amount of the second light receiving unit 432, has changed based on detection results from the second light receiving unit 432 (Step S64). In a case where the second light received amount L2 has not changed (Step S64: NO), that is, in a case where a liquid that has reached the first position P1 does not reach the second position P2, the control unit 50 takes the processing to previous Step S63.

In a case where the second light received amount L2 has changed (Step S64: YES), that is, in a case where a liquid that has passed through the first position P1 has reached the second position P2, the control unit 50 calculates the detected speed Vd, which is the speed of the liquid discharged by the discharging unit 21, based on detection results from the first object detection unit 42 and the second object detection unit 43 (Step S65). Specifically, the control unit 50 calculates the detected speed Vd by dividing the distance from the first position P1 to the second position P2 by a time from a timing when the first light received amount L1 starts to change to a timing when the second light received amount L2 starts to change. That is, in the embodiment, the control unit 50 calculates the detected speed Vd based on timings when a leading end of the liquid discharged from the discharging unit 21 reaches the first position P1 and the second position P2.

Next, the control unit 50 determines whether or not the calculated detected speed Vd falls within an allowable speed range Rv (Step S66). The allowable speed range Rv is a speed range determined in advance through experiments or the like, and determines upper and lower limits of a speed required to land a liquid onto a part of the work W to which the liquid is to be attached.

In a case where the detected speed Vd falls within the allowable speed range Rv (Step S66: YES), the control unit 50 terminates the processing. In this case, since the discharging unit 21 can normally discharge a liquid, the control unit 50 does not limit liquid discharging by the discharging unit 21. In a case where the detected speed Vd does not fall within the allowable speed range Rv (Step S66: NO), the discharging unit 21 cannot normally discharge a liquid. Thus, the control unit 50 limits liquid discharging by the discharging unit 21 (Step S67), and causes the notifying unit 45 to give notice of the limit (Step S68). A case where a liquid cannot be normally discharged due to foreign substances such as bubbles included in the liquid chamber 212 of the discharging unit 21 and a case where a liquid cannot be normally discharged due to foreign substances attached to the vicinity of the opening of the nozzle 225 of the discharging unit 21 can be given as examples of a case where the detected speed Vd does not fall within the allowable speed range Rv. Then, the control unit 50 terminates the processing.

In a case where the elapsed time T3 is equal to or longer than the determination time T3*th* (Step S63: YES) in previous Step S63, the control unit 50 limits liquid discharging by the discharging unit 21 (Step S69), and causes the notifying unit 45 to give notice of the occurrence of dripping in the nozzle 225 of the discharging unit 21 (Step S70). That is, in this case, since a state where an object (liquid) is present at the first position P1 immediately below the nozzle 225 of the discharging unit 21 continues, the control unit 50 determines that a liquid is in a state of dripping from the nozzle 225. After that, the control unit 50 terminates the processing.

In the processing, it is sufficient that the determination time T3*th* is a time slightly longer than a time required for a liquid normally discharged from the discharging unit 21 to fly from the first position P1 to the second position P2. In addition, in the processing, processing of Steps S67 and S69 may be omitted. Accordingly, the notice of a discharge failure and dripping is given but liquid discharging continues.

Next, effects obtained when the discharging apparatus 10 (discharging device 20) discharges a liquid toward the work W will be described with reference to a timing chart shown in FIGS. 8A to 8C.

As shown in FIGS. 8A, 8B, and 8C, in a case where the discharging apparatus 10 discharges a liquid, the second switching valve 224 is switched from the supply state to the open state at a first time t11. At the next second time t12, the first switching valve 223 is switched from the open state to the supply state. For this reason, at the second time t12, the moving body 217 moves from the closed position to the open position, and the nozzle 225 is opened.

Next, the second switching valve 224 is switched from the open state to the supply state at a third time t13. At the next fourth time t14, the first switching valve 223 is switched from the supply state to the open state. For this reason, at the fourth time t14, the moving body 217 moves from the open position to the closed position, and the nozzle 225 is closed.

In this manner, in a period from the first time t11 to the fourth time t14, the moving body 217 temporarily moves to the open position, and a liquid is discharged from the nozzle 225 of the discharging unit 21.

When a fifth time t15 comes after the discharging unit 21 has discharged the liquid, the liquid discharged by the discharging unit 21 starts to pass through the first position P1, and the first light received amount L1 of the first light receiving unit starts to change. Specifically, the liquid discharged by the discharging unit 21 blocks laser light emitted by the first light emitting unit 421, and the first light received amount L1 decreases. Then, when a sixth time t16 comes, the liquid finishes passing through the first position P1, and the first light received amount L1 of the first light receiving unit returns to an original light received amount. That is, the liquid discharged by the discharging unit 21 does not block laser light emitted by the first light emitting unit 421, and the first light received amount L1 increases.

When the liquid discharged by the discharging unit 21 finishes passing through the first position P1 at the sixth time t16, the switching of the first switching valve 223 and the switching of the second switching valve 224 for discharging the next liquid start from a seventh time t17 immediately after the sixth time t16. That is, at the seventh time t17, an eighth time t18, an eleventh time t21, and a twelfth time t22, the switching of the first switching valve 223 and the switching of the second switching valve 224 are performed, as at the first time t11, the second time t12, the third time t13, and the fourth time t14. In this manner, it is possible to discharge the next liquid immediately after the discharging unit 21 has discharged the liquid.

In addition, a liquid that has passed through the first position P1 at the sixth time t16 starts to pass through the second position P2 at a ninth time t19, and finishes passing through the second position P2 at a tenth time t20. In the embodiment, the detected speed Vd is calculated by dividing a distance between the first position P1 and the second position P2 by a time from the fifth time t15 when a liquid discharged by the discharging unit 21 starts to pass through the first position P1 to the ninth time t19 when the liquid starts to pass through the second position P2. Then, in a case where it is found that a liquid has not been normally discharged from the discharging unit 21 based on the calculated detected speed Vd, the notice of the abnormal discharge is given.

Next, effects obtained when a liquid is supplied to the discharging unit 21 in the discharging apparatus 10 (discharging device 20) will be described with reference to a timing chart shown in FIGS. 9A and 9B.

As shown in FIGS. 9A and 9B, at a first time t31, in a state where time has sufficiently passed after the reciprocating pump 233 is switched to the discharging step, a liquid is allowed to be discharged from the discharging unit 21 since the detected pressure Pd of the liquid chamber 212 falls within the allowable pressure range Rp. Next, when a second time t32, at which the reciprocating pump 233 finishes discharging the liquid sucked in the previous suction step, comes, the reciprocating pump 233 is switched from the discharging step to the suction step. Then, while the supply amount of a liquid from the supplying unit 23 to the discharging unit 21 declines, the liquid is continued to be discharged from the discharging unit 21. Therefore, the detected pressure Pd of the liquid chamber 212 starts to gradually decline.

After that, when a third time t33, at which the reciprocating pump 233 finishes sucking the liquid, comes, the reciprocating pump 233 is switched from the suction step to the discharging step. Then, the supply amount of the liquid from the supplying unit 23 to the discharging unit 21 rapidly increases. Therefore, the pressure of a liquid in the liquid flow passage 232 rapidly rises. As a result, after the third time t33, a temporary pressure rise that cannot be prevented by the regulator 235 and the accumulator 234 occurs in the liquid chamber 212.

When a fourth time t34, at which the detected pressure Pd of the liquid chamber 212 exceeds the allowable pressure range Rp, comes, liquid discharging by the discharging unit 21 is limited. For this reason, the discharging unit 21 can be prevented from discharging a liquid toward the work W under a condition unsuitable for discharging the liquid. Then, when a fifth time t35, at which the detected pressure Pd of the liquid chamber 212 falls within the allowable pressure range Rp, comes, liquid discharging by the discharging unit 21 is approved. For this reason, the discharging unit 21 can discharge a liquid toward the work W under a condition where the liquid can be stably discharged again.

Insofar as a time from the fourth time t34 to the fifth time t35 when the detected pressure Pd exceeds the allowable pressure range Rp falls short of the determination time T1*th*, the notifying unit 45 does not give notice of a pressure abnormality of the liquid chamber 212. That is, the notifying unit 45 is prevented from excessively giving notice.

In the discharging apparatus 10 described above, the following effects can be obtained. In the description of the following effects, the effects of the discharging device 20, the temperature regulating device 30, and the inspection device 40 will be described by differentiating from each other with numbers in brackets.

(1-1) The discharging device 20 limits liquid discharging by the discharging unit 21 when the detected pressure Pd does not fall within allowable pressure range Rp as a result of the detected pressure Pd of the liquid supplied to the liquid chamber 212 of the discharging unit 21 fluctuating (pulsating). That is, the discharging unit 21 does not discharge the liquid in a case where the pressure of the liquid supplied to the liquid chamber 212 is a pressure that is not suitable for liquid discharging. In other words, the discharging unit 21 discharges the liquid in a case of a pressure that is suitable for liquid discharging. In this manner, the discharging device 20 can stably discharge the liquid.

(1-2) When intermittently supplying a liquid to the liquid chamber 212 of the discharging unit 21, the pressure of the liquid supplied to the liquid chamber 212 temporarily gets out of the allowable pressure range Rp in some cases at a timing when the supply amount of the liquid to the liquid chamber 212 increases or decreases. However, in this case, the pressure of the liquid supplied to the liquid chamber 212 is likely to fall within the allowable pressure range Rp with the elapse of time. In this respect, in the embodiment, in a case where a state in which the pressure of the liquid supplied to the liquid chamber 212 does not fall within the allowable pressure range Rp continues for the determination time T1*th* or longer, the discharging device 20 causes the notifying unit 45 to give notice of the pressure abnormality. For this reason, when the pressure of a liquid supplied to the liquid chamber 212 falls within the allowable pressure range Rp before the determination time T1*th* elapses, the discharging device 20 does not cause the notifying unit 45 to give notice of the pressure abnormality. In this manner, the discharging device 20 can prevent the notifying unit 45 from excessively giving notice while causing the notifying unit to give notice of a severe pressure abnormality that is not solved with the elapse of time.

(1-3) The inspection device 40 can open or close the nozzle 225 by the switching of the first switching valve 223 and the switching of the second switching valve 224. That is, the discharging device 20 can discharge a liquid from the discharging unit 21 with a simple configuration.

(1-4) In a case where the second switching valve 224 is switched from the supply state to the open state at the same timing as a timing when the first switching valve 223 is switched from the open state to the supply state, the switching of the first switching valve 223 and the switching of the second switching valve 224 are performed in a state where the pressure of the second gas chamber 216 is higher than the pressure of the first gas chamber 215. For this reason, the time it takes for a state where the pressure of the second gas chamber 216 is lower than the pressure of the first gas chamber 215 to come after the switching of the first switching valve 223 and the switching of the second switching valve 224 are performed is likely to become longer. That is, the time it takes for the moving body 217 to move to the open position after the switching of the first switching valve 223 and the switching of the second switching valve 224 are performed is likely to become longer.

On the contrary, in the embodiment, the discharging device 20 switches the first switching valve 223 to the supply state after switching the second switching valve 224 to the open state. For this reason, the discharging device 20 can make a pressure difference between the first gas chamber 215 and the second gas chamber 216 small by the switching of the second switching valve 224, and start the movement of the moving body 217 by the switching of the first switching valve 223. That is, the time it takes for the moving body 217 to move to the open position after the switching of the first switching valve 223 is likely to become shorter. In this manner, it is easy for the discharging device 20 to regulate a timing of starting liquid discharging accompanying the switching of the first switching valve 223 and the second switching valve 224.

(1-5) In a case where the second switching valve 224 is switched from the open state to the supply state at the same timing as a timing when the first switching valve 223 is switched from the supply state to the open state, the switching of the first switching valve 223 and the switching of the second switching valve 224 are performed in a state where the pressure of the first gas chamber 215 is higher than the pressure of the second gas chamber 216. For this reason, the time it takes for a state where the pressure of the first gas chamber 215 is lower than the pressure of the second gas chamber 216 to come after the switching of the first switching valve 223 and the switching of the second switching valve 224 are performed is likely to become longer. That is, the time it takes for the moving body 217 to move to the closed position after the switching of the first switching valve 223 and the switching of the second switching valve 224 are performed is likely to become longer.

On the contrary, in the embodiment, the discharging device 20 switches the first switching valve 223 to the open state after switching the second switching valve 224 to the supply state. For this reason, the discharging device 20 can make a pressure difference between the first gas chamber 215 and the second gas chamber 216 small by the switching of the second switching valve 224, and start the movement of the moving body 217 by the switching of the first switching valve 223. That is, the time it takes for the moving body 217 to move to the closed position after the switching of the first switching valve 223 is likely to become shorter. In this manner, it is easy for the discharging apparatus 10 to regulate a timing of terminating liquid discharging accompanying the switching of the first switching valve 223 and the switching of the second switching valve 224.

(1-6) When a period from the discharge of a liquid by the discharging unit 21 to the discharge of the next liquid is short in a case where the discharging unit 21 continuously discharges the liquid, there is a possibility that the previous liquid discharge affects the next liquid discharging. On the contrary, when a period from the discharge of a liquid to the discharge of the next liquid is long, there is a possibility that the number of times that the discharging unit 21 can discharge the liquid per unit time decreases and a throughput declines. In this respect, in the embodiment, the next liquid discharging is limited until the liquid discharged by the discharging unit 21 passes through the first position P1 immediately below the nozzle 225, and the next liquid discharging is approved after the liquid has passed through the first position P1 immediately below the nozzle 225. For this reason, in a state where the discharging unit 21 continuously discharges a liquid, the discharging device 20 can prevent the previous liquid discharging from affecting the next liquid discharging while preventing a throughput from declining.

(1-7) In a case where the discharging unit 21 fails to discharge a liquid, the liquid drops from the opening of the nozzle 225 in some cases. In this case, there is a possibility that the discharging unit 21 cannot normally discharge a liquid due to the liquid dropping from the opening of the nozzle 225. In this respect, in the embodiment, in a case where a state in which an object is present at the first position P1 immediately below the nozzle 225 continues, that is, in a case where the liquid drops from the opening of the nozzle 225, liquid discharging by the discharging unit 21 is limited. For this reason, the discharging device 20 can prevent a liquid from being discharged in a state where the discharging unit 21 cannot normally discharge the liquid.

(1-8) In addition, in a case where a state in which an object is present at the first position P1 immediately below the nozzle 225 continues, that is, in a case where the liquid drops from the opening of the nozzle 225, the discharging device 20 causes the notifying unit 45 to give notice of the presence of the object. For this reason, the discharging device 20 can let a user of the discharging apparatus 10 know that dripping has occurred at the opening of the nozzle 225.

(1-9) In a case where a state in which an object is present at the first position P1 immediately below the nozzle 225 continues, that is, in a case where the liquid drops from the opening of the nozzle 225, the discharging device 20 cleans the nozzle 225 in order to solve the dripping of the opening of the nozzle 225. In this manner, the discharging device 20 can cause the nozzle 225 to recover a normal state.

(2-1) The temperature regulating device 30 changes the pressure of a heat medium stored in the first storing chamber 321 and the second storing chamber 322 to bidirectionally transport a liquid between the first storing chamber 321 and the second storing chamber 322. For this reason, unlike in a case where a heat medium flows in the heat medium flow passage 323 only in one direction, the temperature of a temperature regulation target can be prevented from becoming uneven.

(2-2) The temperature regulating device 30 can change the pressure of the first storing chamber 321 and the pressure of the second storing chamber 322 by making connection points of the first storing chamber 321 and the second storing chamber 322 to the outside air or to the gas supply source 11 in accordance with the switching of the third switching valve 327. That is, the temperature regulating device 30 can bidirectionally transport a heat medium between the first storing chamber 321 and the second storing chamber 322 even when a rotary machine such as a pump is not used. In this respect, the configuration of the temperature regulating device 30 can be prevented from becoming complicated.

In addition, since a rotary machine, such as a pump, may not be used in a region coming into contact with a heat medium, a user of the temperature regulating device 30 may not determine the material of the rotary machine, or may not determine the type of heat medium based on the corrosion resistance of a portion of the rotary machine, such as a pump, which comes into contact with the heat medium.

(2-3) The temperature regulating device 30 has the first heat medium amount detection unit 331 and the second heat medium amount detection unit 332 detecting the heat medium amounts VL1 and VL2 of the first storing chamber 321 and the second storing chamber 322, and performs the switching of the third switching valve 327 based on the detection results. For this reason, in a state where a heat medium is transported from the first storing chamber 321 to the second storing chamber 322, the third switching valve can be switched to a state where the heat medium is transported from the second storing chamber 322 to the first storing chamber 321 before the heat medium amount VL1 of the first storing chamber 321 becomes 0 (zero). Similarly, in a state where a heat medium is transported from the second storing chamber 322 to the first storing chamber 321, the third switching valve can be switched to a state where the heat medium is transported from the first storing chamber 321 to the second storing chamber 322 before the heat medium amount VL2 of the second storing chamber 322 becomes 0 (zero). In this manner, the temperature regulating device 30 can prevent a state where a heat medium cannot be transported from one storing chamber to the other storing chamber from occurring.

(2-4) When bidirectionally transporting a heat medium between the first storing chamber 321 and the second storing chamber 322, the temperature regulating device 30 can make a time for which the heat medium is transported in one direction and a time for which the heat medium is transported in the other direction substantially the same. For this reason, it is even easier for the temperature regulating device 30 to regulate the temperature of a temperature regulation target so as to be constant.

(2-5) The temperature regulating device 30 can minutely regulate the temperature of a liquid stored in the liquid chamber 212 of the discharging unit 21 by the driving of the first temperature regulating unit 31. In addition, when driving the first temperature regulating unit 31, the temperature regulating device 30 drives the second temperature regulating unit 32. Therefore, the temperature regulating device can prevent an excessive decrease in the temperature of the second face 312 in a case of heat-driving the first temperature regulating unit 31, and can prevent an excessive increase in the temperature of the second face 312 in a case of cool-driving the first temperature regulating unit 31.

(3-1) Unlike a liquid that has been normally discharged from the discharging unit 21, a speed at which a liquid that is not normally discharged from the discharging unit 21 flies a space changes since the size and the shape of the liquid change. In this respect, in the embodiment, in a case where the inspection device 40 determines that the detected speed Vd does not fall within the allowable speed range Rv and a liquid has not been normally discharged from the discharging unit 21, the inspection device causes the notifying unit 45 to give notice of the abnormal discharge. In this manner, the inspection device 40 can check a liquid discharging state regardless of the type of liquid discharged by the discharging unit 21.

(3-2) The inspection device 40 calculates the detected speed Vd based on timings when a liquid discharged from the discharging unit 21 passes through the first position P1 and the second position P2. For this reason, the inspection device 40 calculates the detected speed Vd based on detection results from a simple detection unit that detects the presence or absence of an object at the first position P1 and the second position P2.

(3-3) The shape of a liquid discharged from the discharging unit 21 changes in the middle of flying toward a work in some cases. In this case, the shape of a trailing end of the liquid discharged from the discharging unit 21 in the discharging direction is more likely to change than a leading end does. For this reason, if the detected speed Vd is calculated based on timings when the laser light received amounts of the first light receiving unit 422 and the second light receiving unit 432 stop changing, in other words, timings when a trailing end of the liquid moving in the discharging direction passes through the first position P1 and the second position P2, there is a possibility that the detected speed Vd calculation accuracy declines. In this respect, since the inspection device 40 calculates the speed of a liquid discharged from the discharging unit 21 based on timings when a leading end of the liquid in the discharging direction passes through the first position P1 and the second position P2, a decline in the detected speed Vd calculation accuracy can be prevented.

The embodiment may be changed as follows.

The discharging device 20 may not be configured to discharge a liquid according to a pressure difference between the liquid stored in the liquid chamber 212 of the discharging unit 21 and the outside air. For example, a configuration where a step of filling the nozzle 225 with a liquid by the moving body 217 moving to the open position and a step of discharging a liquid in the nozzle 225 by the moving body 217 moving to the closed position are included may be adopted.

A liquid supplied to the discharging device 20 by the supplying unit 23 may be colored so as to have a color that is likely to absorb laser light. Accordingly, the detection accuracy of the first object detection unit 42 and the second object detection unit 43 can be improved.

The discharging device 20 may have a configuration where the supplying unit 23 is a constant flow valve supplying a fixed amount of liquid to the discharging unit 21. Even in this case, there is a possibility that the pressure of a liquid supplied to the liquid chamber 212 of the discharging unit 21 fluctuates each time the constant flow valve repeatedly supplies a fixed amount of liquid to the discharging unit 21. As described above, it is sufficient that the supplying unit 23 is configured to intermittently supply a liquid to the discharging unit 21.

The cleaning unit 25 of the discharging device 20 may include a wiping unit that wipes the opening of the nozzle 225 with a wiping member such as a brush and a scraper.

After causing a liquid to be discharged from the discharging unit 21, the control unit 50 may cause the discharging device 20 to stand by for a predetermined time and discharge the next liquid from the discharging unit 21. That is, the control unit 50 may not control a timing when the discharging unit 21 discharges a liquid based on detection results from the first object detection unit 42.

When the moving body 217 is moved from the closed position to the open position, the discharging device 20 may switch the second switching valve 224 to the open state after switching the first switching valve 223 to the supply state. In addition, when the moving body 217 is moved from the open position to the closed position, the discharging device may switch the second switching valve 224 to the supply state after switching the first switching valve 223 to the open state. In addition, when the moving body 217 is moved from the closed position to the open position or is moved from the open position to the closed position, the switching of the first switching valve 223 and the switching of the second switching valve 224 may be carried out simultaneously.

Figure 10:
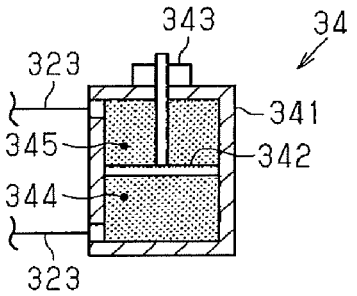
FIG. 10 is a schematic view illustrating a schematic configuration of a second temperature regulating unit according to another embodiment.

The second temperature regulating unit 32 of the temperature regulating device 30 may be changed as illustrated in FIG. 10. As illustrated in FIG. 10, a second temperature regulating unit 34 has a tubular cylinder 341 that stores a heat medium therein, a piston 342 that moves inside the cylinder 341, and an actuator 343 that drives the piston 342. The piston 342 partitions the inside of the cylinder 341 into a first chamber 344 and a second chamber 345. The first chamber 344 is connected to one end of the heat medium flow passage 323 and the second chamber 345 is connected to the other end of the heat medium flow passage 323. The actuator 343 may be configured by a motor and a mechanism converting the rotational motion of the motor into the linear motion of the piston 342.

When the piston 342 of the second temperature regulating unit 34 moves in a direction where the volume of the first chamber 344 decreases, a heat medium stored in the first chamber 344 is transported to the second chamber 345 via the heat medium flow passage 323 by compressing the heat medium stored in the first chamber 344. On the contrary, when the piston 342 of the second temperature regulating unit 34 moves in a direction where the volume of the first chamber 344 increases, a heat medium stored in the second chamber 345 is transported to the first chamber 344 via the heat medium flow passage 323 by compressing the heat medium stored in the second chamber 345. In this manner, the second temperature regulating unit 34 illustrated in FIG. 10 can cause a heat medium to bidirectionally flow in the heat medium flow passage 323 by reciprocating the piston 342 by the driving of the actuator 343.

The temperature regulating device 30 may be a heating device that heats a heating target, which is an example of a temperature regulation target, or may be a cooling device that cools a cooling target, which is an example of the temperature regulation target. In addition, a temperature regulation target of the temperature regulating device 30 may be selected as appropriate. Herein, the heat medium flow passage 323 may be provided inside a temperature regulation target, or may be provided outside the temperature regulation target according to the type of temperature regulation target.

Figure 11:
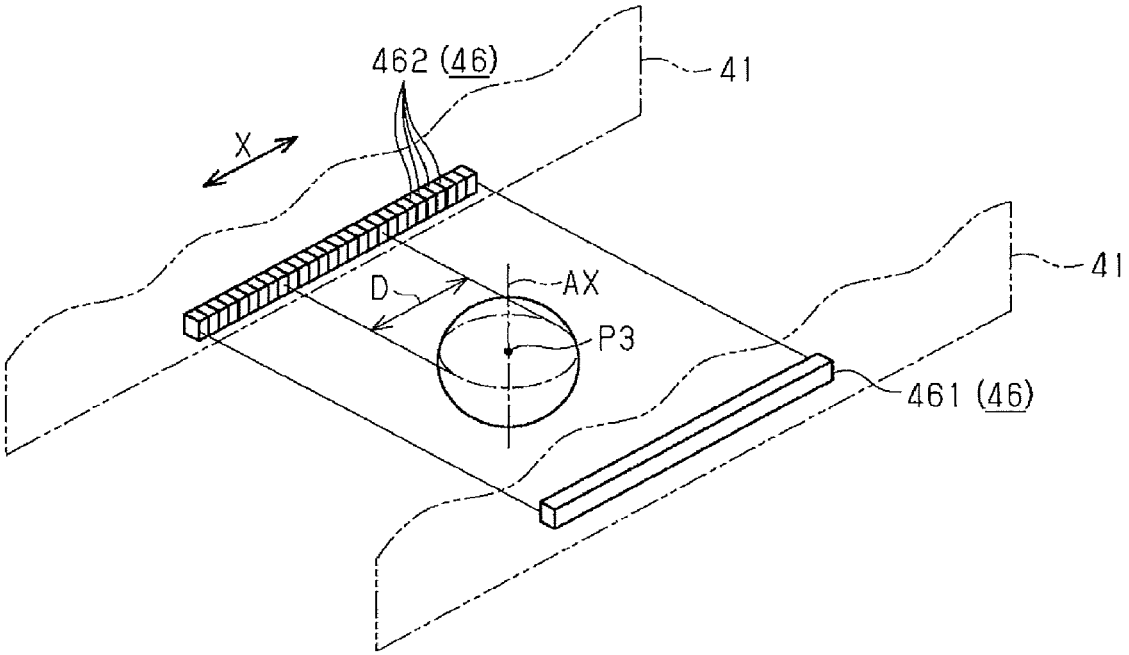
FIG. 11 is a perspective view illustrating a schematic configuration of a third object detection unit included in an observation unit according to another embodiment.

As illustrated in FIG. 11, the inspection device 40 may have a third object detection unit 46 (an example of the observation unit) having a third light emitting unit 461 disposed on one of the pair of extension plates 41 and a plurality of third light receiving units 462 disposed on the other one of the pair of extension plates 41. The third light emitting unit 461 is disposed to extend in the direction orthogonal to the axis AX of the opening of the nozzle 225, and the plurality of third light receiving units 462 are disposed side by side in a longitudinal direction of the third light emitting unit 461. In the following description, a direction where the plurality of third light receiving units 462 are disposed side by side is also referred to as an "arranging direction X".

The third light emitting unit 461 emits laser light to a region that includes a third position P3, which is a position on the axis AX of the opening of the nozzle 225, and that extends in the arranging direction X. The plurality of third light receiving units 462 receive laser light emitted from the third light emitting unit 461, and output detection results according to a light received amount for each predetermined detection interval to the third control unit 53. In a case where a liquid passes through a detection region, the light received amounts of the third light receiving units 462 which have the liquid present between the third light emitting unit 461 and the third light receiving units themselves, out of the plurality of third light receiving units 462, decrease, while the light received amounts of the third light receiving units 462 which do not have the liquid present between the third light emitting unit 461 and the third light receiving units themselves do not change. For this reason, the control unit 50 can acquire the length of the liquid passing through the detection region in the arranging direction X for each detection interval based on the length of a portion where the light received amounts have decreased in the arranging direction X.

Figure 12:
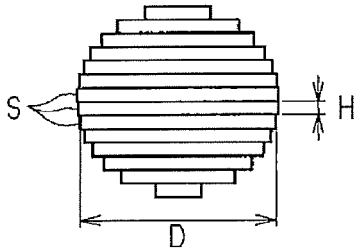
FIG. 12 is a schematic view illustrating a method of calculating a volume of a liquid discharged from a discharging unit based on a detection result from the third object detection unit.

Herein, if it is assumed that a sectional shape of a liquid discharged from the discharging unit 21 orthogonal to the discharging direction is circular, the third control unit 53 can acquire a diameter D of the liquid passing through the detection region of the third object detection unit 46 for each detection interval as illustrated in FIG. 11. As illustrated in FIG. 12, the control unit 50 calculates the volume of a liquid discharged from the discharging unit 21 by regarding the shape of the liquid passing through the detection region per unit time as a cylindrical solid S and adding the cylindrical solids S together. The volume of the cylindrical solid S can be calculated by multiplying a bottom area A of the solid S by a height H. Herein, the bottom area A is the product of $\pi/4$ and the square of the diameter D, and the height H is the product of the detected speed Vd and a detection interval of a liquid.

Next, the third control unit 53 determines whether or not the volume calculated in such a manner (hereinafter, also referred to as a "detected volume") falls within an allowable volume range, and determines whether or not the discharging unit 21 can normally discharge a liquid. Specifically, in a case where the calculated volume of the liquid does not fall within the allowable volume range, the third control unit 53 causes the notifying unit 45 to give notice of being out of range. A case where a liquid cannot be normally discharged due to foreign substances such as bubbles included in the liquid chamber 212 of the discharging unit 21 and a case where a liquid cannot be normally discharged due to foreign substances attached to the vicinity of the opening of the nozzle 225 of the discharging unit 21 can be given as examples of a case where the detected volume does not fall within the allowable volume range.

Accordingly, the inspection device 40 can detect a liquid discharge failure of the discharging unit 21 based on the detected volume in addition to the detected speed Vd. For this reason, the inspection device 40 can improve the liquid discharge failure detection accuracy of the discharging unit 21.

The notifying unit 45 of the inspection device 40 may not give notice each time a discharge failure occurs in the discharging unit 21. For example, after a plurality of times of liquid discharging with respect to one work W have been completed, the notifying unit 45 may give notice of discharge failures all together.

Each of the first object detection unit 42 and the second object detection unit 43 of the inspection device 40 may be a detection unit having a transmitting unit that transmits sonic waves and electromagnetic waves and a receiving unit that receives the sonic waves and the electromagnetic waves, which are transmitted from the transmitting unit. In addition, each of the first object detection unit 42 and the second object detection unit 43 may be a camera that images a liquid discharged by the discharging unit 21. That is, each of the first object detection unit 42 and the second object detection unit 43 may be a sensor that can detect the presence or absence of an object at the first position P1 and the second position P2.

The inspection device 40 may include a fourth object detection unit (an example of the observation unit) that detects the presence or absence of an object at a fourth position which is a position on the axis AX of the opening of the nozzle 225 and is separated further apart from the nozzle 225 than the second position P2 is. In this case, in addition to the speed of a liquid discharged from the discharging unit 21 between the first position P1 and the second position P2, the control unit 50 can acquire the speed of the liquid between the second position P2 and the fourth position, or can acquire the acceleration of the liquid discharged from the discharging unit 21. For this reason, based on a change in the speed of a liquid discharged from the discharging unit 21 (acceleration), the control unit 50 can also determine whether or not the liquid has been normally discharged from the discharging unit 21.

A discharging apparatus according to an aspect of this disclosure includes a discharging unit that includes a liquid chamber which stores a liquid intermittently supplied from a liquid supply source and a nozzle which discharges the liquid stored in the liquid chamber, a pressure detection unit that detects a pressure of the liquid supplied to the liquid chamber, and a control unit that controls the discharging unit based on a detection result from the pressure detection unit. The control unit limits liquid discharging by the discharging unit in a case where the pressure of the liquid supplied to the liquid chamber does not fall within an allowable pressure range.

In the configuration, even in a case where the pressure of the liquid supplied to the liquid chamber fluctuates by intermittently supplying the liquid from the liquid supply source, liquid discharging by the discharging unit is limited when the pressure does not fall within the allowable pressure range. That is, the discharging unit does not discharge the liquid in a case where the pressure of the liquid supplied to the liquid chamber is a pressure that is not suitable for liquid discharging. In other words, the discharging unit discharges the liquid in a case of a pressure that is suitable for liquid discharging. In this manner, the discharging apparatus can stably discharge the liquid.

In the discharging apparatus, it is preferable that a notifying unit that gives notice of a liquid discharging state of the discharging unit be further included, and in a case where a state in which the pressure of the liquid supplied to the liquid chamber does not fall within the allowable pressure range continues, the control unit causes the notifying unit to give notice of the state.

When intermittently supplying the liquid to the liquid chamber, the pressure of the liquid supplied to the liquid chamber temporarily gets out of the allowable pressure range in some cases at a timing when the supply amount of the liquid to the liquid chamber increases or decreases. However, in this case, the pressure of the liquid supplied to the liquid chamber is likely to fall within the allowable pressure range with the elapse of time. In this respect, in the configuration, in a case where a state in which the pressure of the liquid supplied to the liquid chamber does not fall within the allowable pressure range continues, the notifying unit gives notice of this state. For this reason, in a case where pressure fluctuations of the liquid supplied to the liquid chamber are solved in an early stage with the elapse of time, the notifying unit does not give notice. In this manner, the discharging apparatus can prevent the notifying unit from excessively giving notice while causing the notifying unit to give necessary notice.

In the discharging apparatus, it is preferable that the discharging unit includes a gas chamber capable of storing a gas, a moving body that is disposed so as to partition the gas chamber into a first gas chamber and a second gas chamber and moves according to a pressure difference between the first gas chamber and the second gas chamber, a first switching valve that is switched between an open state where the first gas chamber is connected to outside air and a supply state where the first gas chamber is connected to a gas supply source, and a second switching valve that is switched between the open state where the second gas chamber is connected to the outside air and the supply state where the second gas chamber is connected to the gas supply source, and the moving body is disposed at a closed position for closing the nozzle when the first switching valve is switched to the open state and the second switching valve is switched to the supply state, and is disposed at an open position for connecting the liquid chamber to the outside air via the nozzle when the first switching valve is switched to the supply state and the second switching valve is switched to the open state.

In the configuration, the discharging apparatus can move the moving body between the open position and the closed position simply by performing the switching of the first switching valve and the switching of the second switching valve. That is, the discharging apparatus can discharge the liquid from the discharging unit simply by switching the states of the first switching valve and switching the states of the second switching valve.

In the discharging apparatus, it is preferable that when the moving body is moved from the closed position to the open position, the control unit switches the second switching valve to the open state at a timing different from a timing when the first switching valve is switched to the supply state.

In a case where the second switching valve is switched from the supply state to the open state at the same timing as a timing when the first switching valve is switched from the open state to the supply state, the switching of the first switching valve and the switching of the second switching valve are performed in a state where the pressure of the second gas chamber is higher than the pressure of the first gas chamber. For this reason, the time it takes for a state where the pressure of the second gas chamber is lower than the pressure of the first gas chamber to come after the switching of the first switching valve and the switching of the second switching valve are performed is likely to become longer. That is, the time it takes for the moving body to move to the open position after the switching of the first switching valve and the switching of the second switching valve are performed is likely to become longer.

On the contrary, in the configuration, since the switching of the first switching valve and the switching of the second switching valve are performed at different timings, a pressure difference between the first gas chamber and the second gas chamber can be decreased by the switching of the previously switched switching valve, and the movement of the moving body can be started by the switching of the subsequently switched switching valve. That is, the time it takes for the moving body to move to the open position after the switching of the subsequently switched switching valve is likely to become shorter. In this manner, it is easy for the discharging apparatus to control a timing of starting liquid discharging accompanying the switching of the first switching valve and the switching of the second switching valve.

In the discharging apparatus, it is preferable that when the moving body is moved from the open position to the closed position, the control unit switches the second switching valve to the supply state at a timing different from a timing when the first switching valve is switched to the open state.

In a case where the second switching valve is switched from the open state to the supply state at the same timing as a timing when the first switching valve is switched from the supply state to the open state, the switching of the first switching valve and the switching of the second switching valve are performed in a state where the pressure of the first gas chamber is higher than the pressure of the second gas chamber. For this reason, the time it takes for a state where the pressure of the first gas chamber is lower than the pressure of the second gas chamber to come after the switching of the first switching valve and the switching of the second switching valve are performed is likely to become longer. That is, the time it takes for the moving body to move to the closed position after the switching of the first switching valve and the switching of the second switching valve are performed is likely to become longer.

On the contrary, in the configuration, since the switching of the first switching valve and the switching of the second switching valve are performed at different timings, a pressure difference between the first gas chamber and the second gas chamber can be decreased by the switching of the previously switched switching valve, and the movement of the moving body can be started by the switching of the subsequently switched switching valve. That is, the time it takes for the moving body to move to the closed position after the switching of the subsequently switched switching valve is likely to become shorter. In this manner, it is easy for the discharging apparatus to control a timing of terminating liquid discharging accompanying the switching of the first switching valve and the switching of the second switching valve.

In the discharging apparatus, it is preferable that the discharging apparatus further includes a first object detection unit that detects presence or absence of an object at a first position, which is a position on an axis of an opening of the nozzle and is a position immediately below the discharging unit in a liquid discharging direction, and the control unit determines whether or not the liquid discharged from the discharging unit has passed through the first position based on a detection result from the first object detection unit, and limits next liquid discharging by the discharging unit until the liquid discharged from the discharging unit has passed through the first position.

When a period from the discharge of the liquid by the discharging unit to the discharge of the next liquid is short in a case where the discharging unit continuously discharges the liquid, there is a possibility that the previous liquid discharging affects the next liquid discharging. On the contrary, when a period from the discharge of the liquid to the discharge of the next liquid is long, there is a possibility that the number of times that the discharging unit can discharge the liquid per unit time decreases and a throughput declines. In this respect, in the configuration, the next liquid discharging is limited until the liquid discharged by the discharging unit passes through the first position immediately below the nozzle, and the next liquid discharging is approved after the liquid has passed through the first position immediately below the nozzle. For this reason, in a case where the discharging unit continuously discharges the liquid, the previous liquid discharging can be prevented from affecting the subsequent liquid discharging while a throughput can be prevented from declining.

In the discharging apparatus, it is preferable that the discharging apparatus further includes a first object detection unit that detects presence or absence of an object at a first position, which is a position on an axis of an opening of the nozzle and is a position immediately below the discharging unit in a liquid discharging direction, and the control unit limits liquid discharging by the discharging unit in a case where it is determined that a state in which the object is present at the first position continues based on a detection result from the first object detection unit.

In a case where the discharging unit fails to discharge the liquid, the liquid drops from the opening of the nozzle in some cases. In this case, there is a possibility that the discharging unit cannot normally discharge the liquid due to the liquid dropping from the opening of the nozzle. In this respect, in the configuration, in a case where the liquid drops from the opening of the nozzle, that is, in a case where a state in which the object is present at the first position immediately below the nozzle continues, liquid discharging by the discharging unit is limited. For this reason, the liquid can be prevented from being discharged in a state where the discharging unit cannot normally discharge the liquid.

In the discharging apparatus, it is preferable that discharging apparatus further includes a cleaning unit that cleans the nozzle, and the control unit causes the cleaning unit to clean the nozzle in a case where the state in which the object is present at the first position continues.

In the configuration, the discharging apparatus can causes the nozzle to recover a normal state by cleaning the nozzle of the discharging unit that cannot normally discharge the liquid.

The discharging apparatus having the configuration can stably discharge a liquid.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A discharging apparatus comprising:

a discharging unit that includes a liquid chamber which stores a liquid intermittently supplied from a liquid supply source and a nozzle which discharges the liquid stored in the liquid chamber;

a pressure detection unit that detects a pressure of the liquid supplied to the liquid chamber; and a control unit that controls the discharging unit based on a detection result from the pressure detection unit, wherein the control unit limits liquid discharging by the discharging unit in a case where the pressure of the liquid supplied to the liquid chamber does not fall within an allowable pressure range, wherein the discharging unit includes a gas chamber capable of storing a gas, a moving body that is disposed so as to partition the gas chamber into a first gas chamber and a second gas chamber and moves according to a pressure difference between the first gas chamber and the second gas chamber, a first switching valve that is switched between an open state where the first gas chamber is connected to outside air and a supply state where the first gas chamber is connected to a gas supply source, and a second switching valve that is switched between the open state where the second gas chamber is connected to the outside air and the supply state where the second gas chamber is connected to the gas supply source, and the moving body is disposed at a closed position for closing the nozzle when the first switching valve is switched to the open state and the second switching valve is switched to the supply state, and is disposed at an open position for connecting the liquid chamber to the outside air via the nozzle when the first switching valve is switched to the supply state and the second switching valve is switched to the open state.

2. The discharging apparatus according to claim 1, further comprising:

a notifying unit that gives notice of a liquid discharging state of the discharging unit, wherein in a case where a state in which the pressure of the liquid supplied to the liquid chamber does not fall within the allowable pressure range continues, the control unit causes the notifying unit to give notice of the state.

3. The discharging apparatus according to claim 1, wherein when the moving body is moved from the closed position to the open position, the control unit switches the second switching valve to the open state at a timing different from a timing when the first switching valve is switched to the supply state.

4. The discharging apparatus according to claim 1, wherein when the moving body is moved from the open position to the closed position, the control unit switches the second switching valve to the supply state at a timing different from a timing when the first switching valve is switched to the open state.

5. The discharging apparatus according to claim 3, wherein when the moving body is moved from the open position to the closed position, the control unit switches the second switching valve to the supply state at a timing different from a timing when the first switching valve is switched to the open state.

6. The discharging apparatus according to claim 1, further comprising:

a first object detection unit that detects presence or absence of an object at a first position, which is a position on an axis of an opening of the nozzle and is a position immediately below the discharging unit in a liquid discharging direction, wherein the control unit determines whether or not the liquid discharged from the discharging unit has passed through the first position based on a detection result from the first object detection unit, and limits next liquid discharging by the discharging unit until the liquid discharged from the discharging unit has passed through the first position.

7. The discharging apparatus according to claim 2, further comprising:

a first object detection unit that detects presence or absence of an object at a first position, which is a position on an axis of an opening of the nozzle and is a position immediately below the discharging unit in a liquid discharging direction, wherein the control unit determines whether or not the liquid discharged from the discharging unit has passed through the first position based on a detection result from the first object detection unit, and limits next liquid discharging by the discharging unit until the liquid discharged from the discharging unit has passed through the first position.

8. The discharging apparatus according to claim 3, further comprising:

a first object detection unit that detects presence or absence of an object at a first position, which is a position on an axis of an opening of the nozzle and is a position immediately below the discharging unit in a liquid discharging direction, wherein the control unit determines whether or not the liquid discharged from the discharging unit has passed through the first position based on a detection result from the first object detection unit, and limits next liquid discharging by the discharging unit until the liquid discharged from the discharging unit has passed through the first position.

9. The discharging apparatus according to claim 4, further comprising:

a first object detection unit that detects presence or absence of an object at a first position, which is a position on an axis of an opening of the nozzle and is a position immediately below the discharging unit in a liquid discharging direction, wherein the control unit determines whether or not the liquid discharged from the discharging unit has passed through the first position based on a detection result from the first object detection unit, and limits next liquid discharging by the discharging unit until the liquid discharged from the discharging unit has passed through the first position.

10. The discharging apparatus according to claim 1, further comprising:

a first object detection unit that detects presence or absence of an object at a first position, which is a position on an axis of an opening of the nozzle and is a position immediately below the discharging unit in a liquid discharging direction, wherein the control unit limits liquid discharging by the discharging unit in a case where it is determined that a state in which the object is present at the first position continues based on a detection result from the first object detection unit.

11. The discharging apparatus according to claim 2, further comprising:

a first object detection unit that detects presence or absence of an object at a first position, which is a position on an axis of an opening of the nozzle and is a position immediately below the discharging unit in a liquid discharging direction, wherein the control unit limits liquid discharging by the discharging unit in a case where it is determined that a state in which the object is present at the first position continues based on a detection result from the first object detection unit.

12. The discharging apparatus according to claim 3, further comprising:

a first object detection unit that detects presence or absence of an object at a first position, which is a position on an axis of an opening of the nozzle and is a position immediately below the discharging unit in a liquid discharging direction, wherein the control unit limits liquid discharging by the discharging unit in a case where it is determined that a state in which the object is present at the first position continues based on a detection result from the first object detection unit.

13. The discharging apparatus according to claim 4, further comprising:

a first object detection unit that detects presence or absence of an object at a first position, which is a position on an axis of an opening of the nozzle and is a position immediately below the discharging unit in a liquid discharging direction, wherein the control unit limits liquid discharging by the discharging unit in a case where it is determined that a state in which the object is present at the first position continues based on a detection result from the first object detection unit.

14. The discharging apparatus according to claim 6, wherein the control unit limits liquid discharging by the discharging unit in a case where it is determined that a state in which the object is present at the first position continues based on a detection result from the first object detection unit.

15. The discharging apparatus according to claim 10, further comprising:

a cleaning unit that cleans the nozzle, wherein the control unit causes the cleaning unit to clean the nozzle in a case where the state in which the object is present at the first position continues.

* * * * *